US011002082B2

(12) United States Patent
Swadi et al.

(10) Patent No.: US 11,002,082 B2
(45) Date of Patent: May 11, 2021

(54) MILLABLE BIT TO WHIPSTOCK CONNECTOR

(71) Applicant: Wellbore Integrity Solutions LLC, Houston, TX (US)

(72) Inventors: Shantanu N. Swadi, Houston, TX (US); Charles H. Dewey, Houston, TX (US); Tuan Anh Nguyen, Pearland, TX (US); John Edward Campbell, Houston, TX (US); Shelton W Alsup, Houston, TX (US)

(73) Assignee: Wellbore Integrity Solutions LLC, Houston, TX (US)

( * ) Notice: Subject to any disclaimer, the term of this patent is extended or adjusted under 35 U.S.C. 154(b) by 367 days.

(21) Appl. No.: 15/737,803

(22) PCT Filed: Jun. 16, 2016

(86) PCT No.: PCT/US2016/037716

§ 371 (c)(1),
(2) Date: Dec. 19, 2017

(87) PCT Pub. No.: WO2016/209686

PCT Pub. Date: Dec. 29, 2016

(65) Prior Publication Data

US 2019/0003264 A1 Jan. 3, 2019

Related U.S. Application Data

(60) Provisional application No. 62/183,281, filed on Jun. 23, 2015, provisional application No. 62/183,288, filed on Jun. 23, 2015.

(51) Int. Cl.
*E21B 7/06* (2006.01)
*E21B 17/02* (2006.01)
(Continued)

(52) U.S. Cl.
CPC ..... *E21B 17/02* (2013.01); *E21B 7/061* (2013.01); *E21B 29/002* (2013.01); *E21B 23/01* (2013.01)

(58) Field of Classification Search
CPC ..... E21B 7/061
See application file for complete search history.

(56) References Cited

U.S. PATENT DOCUMENTS 2,134,287 A * 10/1938 Matlock ..... E21B 7/061 166/117.6
5,431,220 A 7/1995 Lennon et al.
(Continued)

OTHER PUBLICATIONS

C95510HT product spec sheet, Concast Metal Products, Dec. 22, 2010 (Year: 2010).*
(Continued)

*Primary Examiner* — Giovanna Wright
(74) *Attorney, Agent, or Firm* — Hubbard Johnston, PLLC

(57) ABSTRACT

A departure device couples to a bit using a connector that facilitates release of the bit from the departure device. The connector may be more millable than the departure device and can transmit axial and torque loads between the bit and the departure device. The connector may include a material having lesser strength or hardness than the departure device, and may be millable by the bit. Another example connector may have connection points with the bit, and a movable member of the departure device may a force to the connector and contribute to releasing the connection between the bit and the departure device. A tensile connector between the bit and the movable member may apply a tension force to the movable member, urging the movable member toward an extended position in which the movable member is aligned coherently with a sloped face of the departure device.

23 Claims, 17 Drawing Sheets

(51) Int. Cl.
*E21B 29/00* (2006.01)
*E21B 23/01* (2006.01)

(56) References Cited

U.S. PATENT DOCUMENTS

| | | | | |
|---|---|---|---|---|
| 5,709,265 | A * | 1/1998 | Haugen | E21B 7/061 166/117.6 |
| 8,739,900 | B2 | 6/2014 | Gregurek et al. | |
| 8,997,895 | B2 | 4/2015 | Swadi et al. | |
| 9,004,159 | B2 | 4/2015 | Alsup et al. | |
| 9,228,406 | B2 | 1/2016 | Swadi et al. | |
| 9,347,268 | B2 | 5/2016 | Grigor et al. | |
| 2002/0170713 | A1* | 11/2002 | Haugen | E21B 7/061 166/298 |
| 2003/0141063 | A1 | 7/2003 | Haugen et al. | |
| 2010/0224372 | A1 | 9/2010 | Stowe et al. | |
| 2010/0307736 | A1* | 12/2010 | Hearn | E21B 7/061 166/117.5 |
| 2013/0020093 | A1 | 1/2013 | Guidry et al. | |
| 2014/0216819 | A1 | 8/2014 | Gregurek et al. | |
| 2015/0152703 | A1* | 6/2015 | Haun | E21B 29/06 166/298 |

OTHER PUBLICATIONS

C95400 product spec sheet, Concast Metal Products, , Jul. 27, 2010 (Year: 2010).*

"Timken introduces two high performance alloy steel grades", Offshore Magazine, Offshore Staff, Nov. 11, 2013 (Year: 2013).*

International Search Report and Written Opinion issued in International Patent Application No. PCT/US2016/037716, dated Sep. 7, 2016, 20 pages.

International Preliminary Report on Patentability issued in International Patent Application No. PCT/US2016/037716, dated Jan. 4, 2018, 17 pages.

* cited by examiner

MILLABLE BIT TO WHIPSTOCK CONNECTOR

CROSS-REFERENCE TO RELATED APPLICATIONS

This application claims the benefit of, and priority to, U.S. Patent Application Ser. No. 62/183,288, filed Jun. 23, 2015 and U.S. Patent Application Ser. No. 62/183,281, filed on Jun. 23, 2015, each of which is expressly incorporated herein by this reference in its entirety.

BACKGROUND

A wellbore may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. The formations through which the wellbore passes can be evaluated for a variety of properties, including the presence of hydrocarbon reservoirs in the formation, and the trajectory of the wellbore may be altered to optimize the location of the wellbore in the formation. In a process known as sidetracking, deviated or lateral boreholes may also be drilled to branch off from a wellbore in order to extend access to other areas of the formation. Wellbores and lateral boreholes may be drilled using a drill bit attached to the downhole end of a drill string.

When a lateral borehole is formed to branch off from a wellbore, a whipstock may be placed in the primary wellbore. The whipstock may include a ramped face used to direct a bit laterally away from the longitudinal axis of the wellbore. In a cased wellbore, a window may be milled through the casing in order to open the casing to the surrounding formation before drilling resumes to produce a lateral borehole. In an openhole wellbore, the bit may directly access the surrounding formation for a drilling operation used to produce the lateral wellbore.

The orientation of the whipstock may direct the bit laterally during the sidetracking operation. A connector between drill string and the whipstock may allow the whipstock to be directed through a wellbore and oriented in the wellbore. The whipstock may then be anchored within the wellbore. The drill string may be tripped out of the wellbore, and a bit may be tripped into the wellbore to commence the milling and/or drilling process.

SUMMARY

According to some embodiments, a connector for coupling a bit to a departure device may include a body having a yield strength between 30 ksi (205 MPa) and 70 ksi (485 MPa). Push and torque loading areas may be located at a proximal end portion of the body and configured to receive axial forces and torque, respectively. Push and torque transmission areas may be located at a distal end portion of the body and configured to transmit axial forces and torque, respectively.

In some embodiments, a downhole tool may include a bit, a departure device formed of a first material, and a connector formed of a second material. The second material may be more millable than the first material, and the connector may couple the bit to the departure device.

In still additional embodiments, a wellbore departure method may include tripping a downhole tool into a wellbore. The downhole tool can include a departure device, a bit, and a connector coupling the bit to the departure device. The connector may be configured to be more millable than the departure device. The departure device may be positioned in the wellbore and the bit may be disconnected from the departure device. The bit may be moved relative to the departure device, and the bit may be used to mill the connector.

In some embodiments, a device may include an elongate body having a sloped surface. The device may include a connector proximate a first end of the elongate body. A movable member may move at least partially within the elongate body and to apply a force to the connector.

A method of placing a departure device, in some embodiments, may include tripping a departure device comprising an elongate body, a connector, and a movable member into a wellbore. The elongate body may have a sloped surface. The movable member may apply a force to the connector when moved toward an extended position. The method may also include orienting the departure device in the wellbore and securing the departure device in the wellbore. The method may further include moving the movable member towards the extended position and thereby applying a force to release the connector.

In some embodiments, a system may include a departure device, a bit, and an expandable anchor. The departure device may include an elongate body having a sloped surface. The departure device may also include a connector proximate a first end of the elongate body, which may connect the first end of the elongate body to the bit. A movable member of the departure device may be movable between a retracted position and an extended position. A surface of the movable member may align coherently with the sloped surface when the movable member is in the extended position. The expandable anchor may be connected proximate a second end of the elongate body. The expandable anchor may be configured to secure the system to the interior of a wellbore and hold the system in place.

This summary is provided to introduce a selection of concepts that are further described herein. This summary is not intended to identify specific features of the claimed subject matter, nor is it intended to be used as an aid in limiting the scope of the claimed subject matter. Indeed, additional features of embodiments of the disclosure will be set forth in the description which follows. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. Unless described as schematic or exaggerated, the drawings should be considered to be scale for some embodiments. The drawings are not, however, to scale for each embodiment contemplated by the present disclosure.

DETAILED DESCRIPTION

Figure 1:
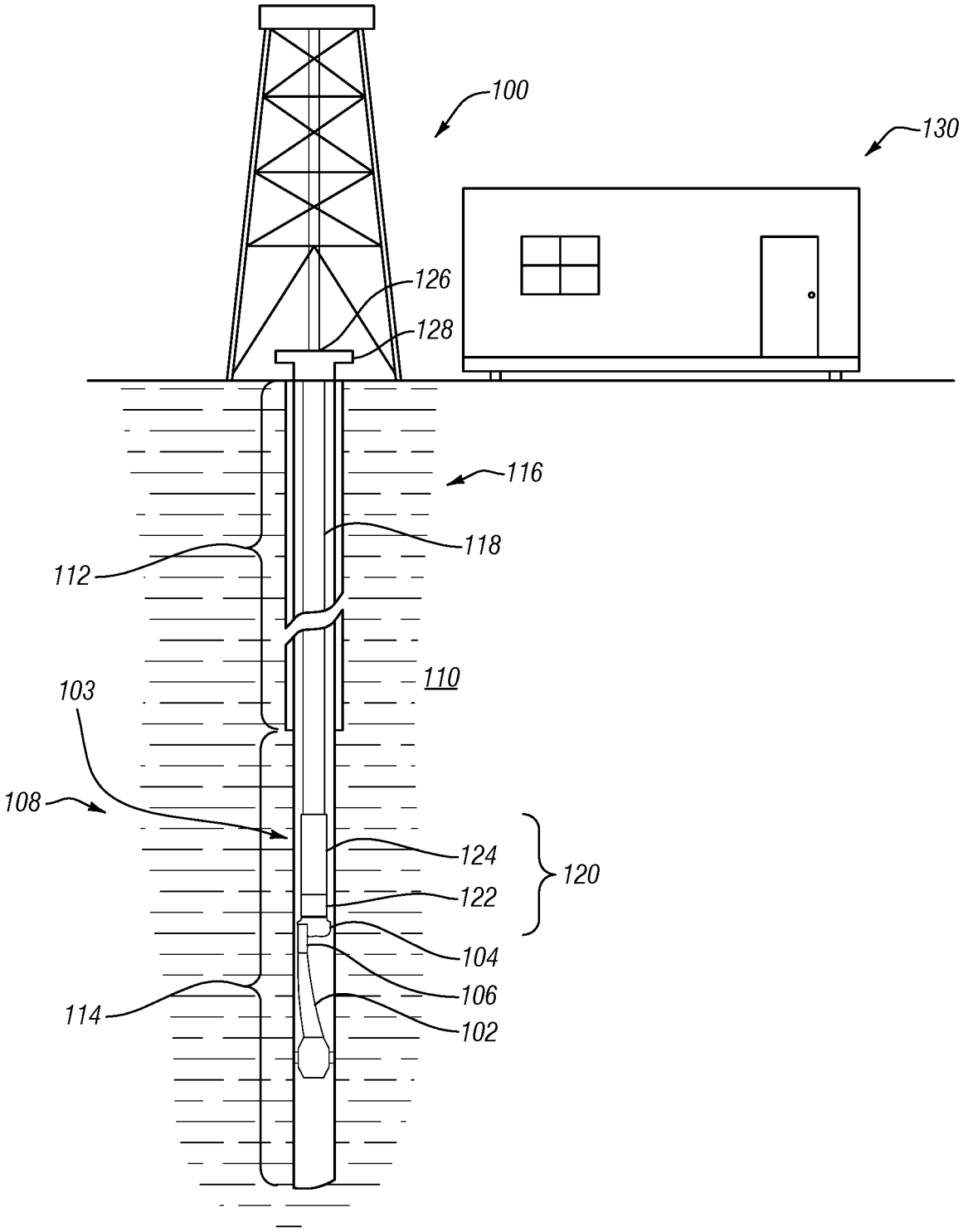
FIG. 1 is a schematic representation of a drilling system including a departure device placed in a wellbore using a connector coupling the delivery device to a delivery mechanism, according to one or more embodiments of the present disclosure.

Some Embodiments of the present disclosure may generally relate to devices, systems, and methods for placement of a departure device in a wellbore or borehole. More particularly, embodiments disclosed herein may relate to single trip orienting and/or anchoring of a whipstock in a wellbore or borehole and initiation of a lateral borehole. Some embodiments disclosed herein relate to a connector that couples a bit to a whipstock or other departure device. Optionally, example connectors can be fully or partially removed using a milling and/or drilling systems, assemblies, and tools. Some embodiments of the present disclosure relate to methods for forming a lateral borehole departing from a wellbore or other lateral borehole. Even more particularly, some embodiments disclosed herein may relate to devices, systems, and methods of delivering, orienting, and anchoring a whipstock or other departure device coupled to a bit via a millable connector. The bit may be a fixed cutter bit (e.g., a polycrystalline diamond compact ("PDC") bit), a roller-cone bit, a drill bit, a mill, or other suitable bit. Example bits may be suitable for use in an openhole environment for forming a lateral borehole subsequent to release of the bit from the departure device and/or milling of the connector. In at least some embodiments, delivering, orienting, and anchoring a departure device and forming a lateral borehole may occur in a single trip.

A departure device, in some embodiments, may include one or more release mechanisms that allow the departure device to be separated from a drill string or other delivery mechanism. The delivery mechanism may be a cutting tool (e.g., a drill bit, a mill, etc.), a bottomhole assembly, or other delivery mechanism that may be, in some embodiments, directly or indirectly coupled to a drill string. In at least some embodiments, a delivery mechanism may allow the departure device to be oriented and and/or anchored, and initiation of a sidetracking (or wellbore departure) operation in a single trip. A connector may allow the delivery mechanism to apply axial forces, radial forces, torsional forces, or combinations thereof, to the departure device to deliver the departure device to a desired position within a wellbore. The connector may be a millable connector configured or otherwise designed to be degraded or removed by the delivery mechanism (e.g., milled away by a bit) to facilitate desired radial and/or axial movement of the delivery mechanism relative to the departure device. In at least some embodiments, wellbore departure operations within a cased wellbore may be relatively predictable due to the known conditions and parameters of the casing to which the departure device will be anchored. When departing an openhole (i.e., uncased) wellbore, the placement of the departure device may encounter other challenges, such as variations in the geometry of the wellbore, variations in the formation (e.g., formation strength, porosity, etc.) surrounding the wellbore, variations in the fluid pressures within the wellbore, and the like. Such variations may cause conditions in an openhole wellbore to be less predictable or more challenging. While some embodiments depicted and described herein may reference a bit (e.g., a drill bit or a mill), embodiments may be used in conjunction with other delivery mechanisms.

FIG. 1 illustrates a drilling system 100 having a departure device 102 coupled to a delivery mechanism 103. The delivery mechanism 103 may include various components, including a bit 104. The bit 104 may be coupled to the departure device 102 by a connector 106, in accordance with one or more embodiments of the present disclosure. In some embodiments, the connector 106 may be a millable connector.

FIG. 1 also depicts a primary wellbore 108 extending into a formation 110. The term "primary wellbore," as used herein, refers to a wellbore or borehole from which a deviated or lateral borehole may begin. For example, a lateral borehole may be a sidetracked borehole that branches off of, or otherwise extends laterally from, the primary wellbore. The primary wellbore may itself be a wellbore extending to the surface or may be a branch off one or more other wellbores or boreholes. The term "lateral borehole" should be understood as describing a borehole extending at an angle from a longitudinal axis of the primary wellbore, and should not limit the application of the technique or techniques described herein. For example, a lateral borehole may extend from a lateral surface of a primary wellbore. In other words, a lateral borehole may extend at a non-parallel angle from a lateral surface of a primary wellbore.

FIG. 1 depicts a primary wellbore 108 that may have an optional cased portion 112. The cased portion 112 may include casing or liner installed therein to reinforce the primary wellbore 108 against the fluid pressure of the formation 110, to isolate the wellbore 108 from fluids within the formation 110, or for myriad other purposes. The length and/or presence of the cased portion 112 may vary depending on the formation 110 through which the primary wellbore 108 is drilled, the function of the wellbore 108, and the like. In some embodiments, the primary wellbore 108 may include an uncased or "openhole" portion 114 in which no casing or liner lines the primary wellbore 108. The openhole portion 114 may extend through the formation 110 with little or no additional reinforcement. In some embodiments, the cased portion 112 may be less than entirely cased about the circumference of the cased portion 112. For example, a window or other feature may be formed by removing a section of the cased portion 112. In other embodiments, a full or significant length of the primary wellbore 108 may be cased. In still other embodiments, the openhole portion 114 may extend a full length of the primary wellbore 108.

The departure device 102 may be positioned in the primary wellbore 108 by using the delivery mechanism 103. The delivery mechanism 103 may include a drill string 116. The drill string 116 may include a tubular 118 and a bottomhole assembly (BHA) 120. The tubular 118 may include a number of components such as drill pipe, coiled tubing, drill collars, transition drill pipe (e.g., heavy weight drill pipe), or similar components. In some embodiments, the tubular 118 may transmit torque and/or longitudinal force through the primary wellbore 108 to the BHA 120. In the same or other embodiments, the tubular 118 may be used to transmit fluid to the BHA 120. Optionally, the BHA 120 may include a mud motor (e.g., turbine-powered motor, positive displacement motor, etc.) to convert fluid flow to a rotational force that may then rotate the bit 122 or other components of the BHA 120. The BHA 120 may include the bit 104, which may be configured to remove material from the formation 110 to extend the primary wellbore 108 and/or to drill a lateral borehole extending from the primary wellbore 108. In a cased wellbore (or cased portion of the primary wellbore 108), the bit 104 may be a mill, such as a window mill or section mill, that may mill through casing material to create a window through which the lateral borehole may be drilled. In an openhole wellbore (or openhole portion of the primary wellbore 108), the bit 104 may be a drill bit that may drill through the formation 110 to form the lateral borehole. In some embodiments, the bit 104 may be used as a mill-drill bit for both milling casing (or components within a wellbore as discussed in more detail herein) and drilling formation. In some embodiments, a drill bit may be used for removing casing or other non-formation materials and/or a mill may be used in an openhole wellbore or to remove formation. In further embodiments, other bits may be used for one or both an openhole or a cased wellbore. In at least some embodiments, a connector 106 configured to couple the departure device 102 to the bit 104 or other component of the delivery mechanism 103 may allow the departure device 102 to be positioned (e.g., oriented and/or anchored) within the primary wellbore 108 and a lateral borehole to be fully or partially formed in a single trip.

According to some embodiments, the BHA 120 may include a directional mechanism used to guide or steer the BHA 120 and/or the bit 104. For instance, a directional mechanism may include a steerable portion 122 located on, near, or adjacent to the bit 104. In some embodiments, the steerable portion 122 may direct (i.e., guide) the bit 104. For example, the steerable portion 122 may direct the bit during any applicable stage of the wellbore departure process (e.g., drilling, milling, orienting and anchoring of the departure device, or combinations thereof). Example steerable portions 122 may include bent housings, point-the-bit, push-the-bit, or other directional mechanisms. Optionally, the steerable portion 122 may be used to obtain a bit path or trajectory which deviates from an existing wellbore or borehole, an inclined wellbore or borehole, a curved wellbore or borehole, or combinations of the foregoing. In at least some embodiments, the steerable portion 122 may be removed (e.g., the departure device 102 may direct the path of the bit 104 without additional steering).

The BHA 120 may include one or more sensors or data collection modules 124. The data collection modules 124 may collect information regarding the state of the fluid present in the formation 110, properties of the formation 110, the state of the drilling system 100, progress of a drilling process, other information, or combinations thereof. The data collection modules 124 may include measurement-while-drilling ("MWD") modules, logging-while-drilling ("LWD") modules, proximity sensors, pressure sensors, velocity sensors, visibility sensors, accelerometers, gyroscopes, temperature sensors, vibration sensors, other sensors, or a combination of the foregoing. The data collection modules 124 may be located on or within any component of the BHA 120, coupled to the BHA 120 as stand-alone or modular components (e.g., measurement subs), or otherwise coupled to the drill string 116.

In some embodiments, the drill string 116 may transmit torque from the surface. For instance, a kelly 126 mated to a rotary table 128 may have a kelly bushing (not shown) which may have an inside profile that may complimentarily mate with an outside profile of the kelly 126, such as a square, hexagon, or other polygonal shape. Such mating may allow the kelly 126 to transmit torque to the drill string 116. Optionally, the kelly 126 may move longitudinally relative to the rotary table 128 in order to transmit longitudinal forces to the drill string 116. In other embodiments, the drill string 116 may be rotated by another torque transmitting device. For instance, a top drive (not shown) may be used. In still other embodiments, a downhole torque transmitting device (e.g., a mud motor, a turbine-powered motor, etc.) may be used. For instance, a downhole motor may be coupled to segmented drill pipe or coiled tubing, and may include a positive displacement motor, turbine, or the like to rotate a drive shaft coupled to a portion of the drill string 116 (e.g., bit 104).

The rotation and/or longitudinal movement of the drill string 116 may be controlled via a control system. The control system may receive information from surface and/or downhole sources. For example, the data collection modules 124 may send instructions or data which may be used to control the rotational speed of the drill string 116, the flow of fluid into the drill string 116 or wellbore 108, the weight on the bit 104, or the like. Where the data collection modules 124 provide information used to orient and/or anchor the departure device 102 or drill a lateral borehole, the information may be used in an open-loop or closed-loop control system. For instance, pre-programmed software, hardware, firmware, or the like may enable the data collection modules 124 to automatically steer the BHA 120, including the bit 104, when forming the lateral borehole. In other embodiments, however, the control system may be an open loop control system which may use surface controls, and potentially operator-assisted controls.

Information may be provided from the data collection modules 124 to a controller (e.g., at the surface or in the drill string 116 or BHA 120) or operator. The controller or operator may review or process data received from the data collection modules 124 and/or may provide instructions or control signals to the control system to direct drilling of the lateral borehole and/or orienting and anchoring of the departure device 102. The data collection modules 124 may include controllers positioned downhole and/or at the surface that may vary the operation of (e.g., steer or orient) the bit 104, the departure device 102 via the connector 106, or other portions of the BHA 120. Mud pulse telemetry, wired drill pipe, fiber optic coiled tubing, wireless signal propagation, radio-frequency identification (RFID) tags, other information transmission techniques, or combinations thereof may be used to send information to or from the surface.

As shown in FIG. 1, information collected regarding the position, orientation, or other status of the drill string 116, formation 110, departure device 102, or other portions of the drilling system 100 may be communicated to an operations center 130, depicted herein as a fixed operations center. In other embodiments, the operations center 130 may be a mobile operations center housed in a vehicle or a movable structure. The operations center 130 may be local or remote relative to the primary wellbore 108 and may include a computing system that may include or have access to a controller to receive and/or process data transmitted from the surface and/or BHA 120 (e.g., data from the data collection modules 124 and/or regarding the steerable portion 122, the bit 104, or the departure device 102). While the drilling system 100 depicted in FIG. 1 is a land-based drilling system, it should be understood that embodiments of the present disclosure are also applicable to other drilling systems, including offshore rigs.

Figure 2:
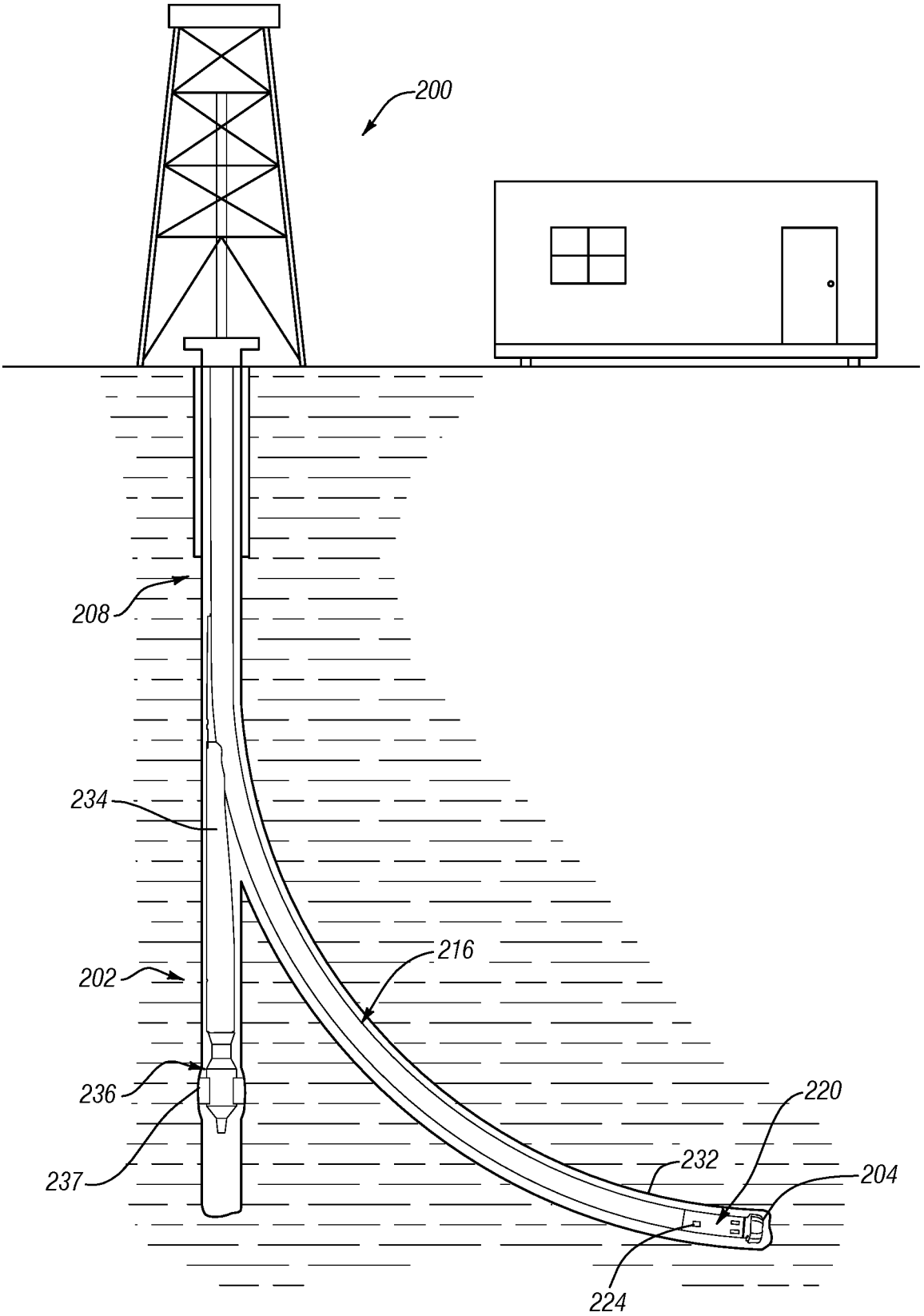
FIG. 2 is a schematic representation of a drilling system including a departure device forming a lateral borehole, according to one or more embodiments of the present disclosure.

FIG. 2 illustrates a drilling system 200 in which a lateral borehole 232 is formed and departs from a primary wellbore 208 with the assistance of a departure device 202. As discussed in more detail herein, formation of the lateral borehole 232 may occur after a BHA 220 (including bit 204) is released from a departure device 202, and optionally after fully or partially removing a connector which previously coupled the BHA 220 to the departure device 202. The departure device 202 may include a whipstock 234 coupled to an anchor 236 or other securing device. In at least some embodiments, the departure device 202 may have a connector that may allow the departure device 202 to connect to a bit 204, other component of a BHA 220, other delivery mechanism, or combinations thereof. The connector may facilitate the transmission of torque and/or longitudinal force applied to a drill string 216 (whether from a surface or downhole source) to the departure device 202. The departure device 202 may thereby be oriented to a desired azimuth (i.e., rotated) and/or moved (i.e., advanced and/or retracted) within the primary wellbore 208 to place the departure device 202 in a particular orientation in the primary wellbore 208. In some embodiments, the connector may be a millable connector configured to be milled or otherwise degraded by the bit 204 after the departure device 202 is separated from the BHA 220.

The orientation of the departure device 202 in the primary wellbore 208 may at least partially determine the orientation of the lateral borehole 232. The lateral borehole 232 may be drilled and/or the departure device 202 may be placed by a similar (or the same) drill string 216 as that used to drill the primary wellbore 208. In other embodiments, the drill string 216 coupled to the departure device 202 may be different than the drill string used to drill the primary wellbore 208. After positioning the departure device 202 in the primary wellbore 208, the anchor 236 may be activated to secure the departure device 202 in place within the primary wellbore 208. Activation of the anchor 236 may include, in some embodiments, moving expandable members 237 radially outward, expanding a sealing element, or other techniques which engage the internal wall of the primary wellbore 208 (or casing in a cased wellbore) to secure the anchor 236 at a particular orientation and/or axial position in the primary wellbore 208. In at least some embodiments, activating the anchor 236 to secure the departure device 202 in place may facilitate separation of the departure device 202 from the drill string 216. Data may be acquired by the BHA 220 (e.g., acquired by data collection modules 224), and may relate to the state of the system (e.g., drilling progress, position in a wellbore, formation properties, fluid properties, position of a steering system, orientation, etc.), and may be stored downhole, transmitted to the surface, or otherwise handled.

Figure 3:
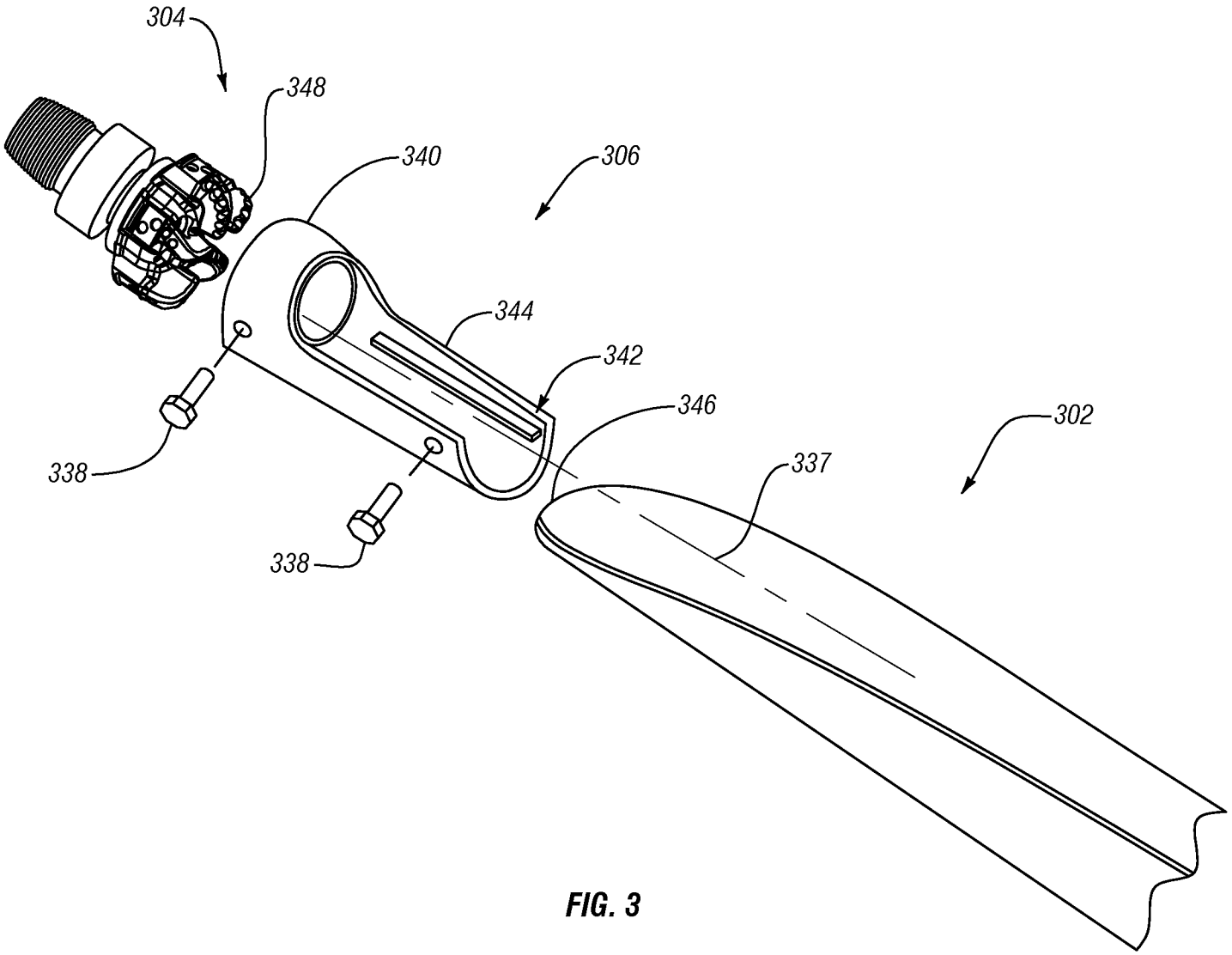
FIG. 3 is an exploded perspective view of a connector located between a bit and a departure device, according to one or more embodiments of the present disclosure.

FIG. 3 is an exploded perspective view of a departure device 302 coupled to a bit 304 by a connector 306, according to some embodiments of the present disclosure. The connector 306 may have a body 344 having an uphole or proximal end portion 340 and a downhole or distal end portion 342. The proximal end portion 340 of the connector 306 may be an end of the connector 306 proximate the bit 304 or a BHA when in use, or which is nearer the surface as compared to the distal end portion 342. For example, the proximal end portion 340 of the connector 306 may be closer to the kelly 126 and/or rotary table 128 described in relation to FIG. 1 than the distal end portion 342. The distal end portion 342 of the connector 306 may be an end of the connector 306 more distal to the bit 304 or BHA (and the surface) when in use. For example, the distal end portion 342 may be closer the departure device 302 when compared to the proximal end portion 340. In at least one embodiment, the proximal end portion 340 may be coupled to a delivery mechanism (e.g., the bit 304) and the distal end portion 342 may be coupled to the departure device 302. In some embodiments, the body 344 may extend along, and optionally be about parallel to, a longitudinal axis 337 extending from the bit 304 to the departure device 302. In some embodiments, the body 344 may longitudinally overlap at least a portion of the departure device 302 such that the distal end portion 342 of the connector 306 may be located further from the surface, when in use, than a proximal end portion 346 of the departure device 302. In some embodiments, the body 344 may longitudinally overlap at least a portion of the bit 304 such that the proximal end portion 340 of the connector 306 may be located nearer the surface, when in use, than a distal end portion 348 of the bit 304.

The connector 306 may be located at or near a proximal or upper location of the departure device 302, and in some embodiments may be releasable from the delivery mechanism (e.g., the bit 304), the departure device 202, or both. In some embodiments, the connector 306 may be coupled to the bit 304 by a releasable, frangible, or breakable fastener that includes one or more shear elements (e.g., shear pins 338). In some embodiments, the connector 306 may be coupled to the departure device 302 by a releasable or breakable fastener that includes one or more shear elements (e.g., shear pins 338). In the same or other embodiments, the connector 306 may configured to be milled, broken-up, or otherwise degraded while downhole. For instance, the connector 306 may be a millable connector that is released from the bit 304 and milled by the bit prior to the bit forming a lateral borehole. In some embodiments, the connector 306 may be coupled to the departure device 302 by a connection suitable to limit or prevent movement of the connector 306 during degradation of the connector 306 (e.g., while the connector 306 is being milled). For example, the connector 306 may be coupled to the departure device 302 by welding, brazing, bolting, clamping, mechanically locking, other techniques, or combinations thereof. In yet further embodiments, the connector 306 may be integrally formed with the departure device 302. For example, the connector 306 may be forged or machined with the departure device 302. The connector 306 may, in some embodiments, include a portion of the departure device 302 having a reduced volume of material. In other embodiments, the connector 306 may include a second material having a lesser yield strength than a body of the departure device 302. In such an example, the connector 306 may be a portion of the departure device 302 that would be removable by a cutting tool, such as a drill bit or mill, while the body of the departure device 302 may direct the cutting tool laterally to initiate formation of a lateral borehole. In other example embodiments, the connector 306 may be a non-work-hardened portion of a departure device 302 that has a body of work-hardened material (such as steel).

When the fastener includes one or more shear pins 338, the shear pins 338 may be threaded or unthreaded. Threaded shear pins 338 (i.e., shear bolts) may mate with a threaded portion of the departure device 302, the bit 304, or nuts configured to retain the shear bolts in place. The shear elements or other releasable or breakable fasteners of the connector 306 may be configured to break and/or release when a total force applied to the shear elements or other releasable or breakable fasteners exceeds a threshold force, irrespective of the size or material of the shear elements or other releasable or breakable fasteners. For example, a connector 306 may include smaller and/or fewer shear elements when made of a relatively higher yield strength material, or larger and/or more shear elements when made of a relatively lower yield strength material. In some embodiments, the shear elements or other releasable or breakable fasteners of the connector 306 may be configured to break at a threshold force in a range between 40 and 60 kilopounds (178 and 270 kN). For instance, the shear elements or other releasable or breakable fastener may shear at a threshold force in a range between 30 and 80 kilopounds (133 and 356 kN). For instance, the releasable fastener may break or otherwise release when subjected to a threshold force within a range having lower and/or upper limits that include any of 30, 40, 42, 44, 46, 48, 50, 52, 54, 56, 58, 60, 70, 80 kilopounds, (133, 178, 186, 195, 204, 212, 222, 230, 238, 245, 253, 261, 270, 311, 356 kN), or any value therebetween. For instance, shear elements may break when a force is applied in a range between 45 and 55 kilopounds (200 and 245 kN) or between 50 and 60 kilopounds (222 and 270 kN). In still other embodiments, the shear elements or other releasable or breakable fasteners may shear when subjected to a threshold force that is less than 30 kilopounds (133 kN) or more than 80 kilopounds (356 kN). The releasable fastener may be configured to break or otherwise release experiencing an axially upwardly or downwardly directed force, a rotational force, a radially directed force, an impact force, or any combination of the foregoing.

The connector 306 may be configured to transmit downhole, uphole, or rotational forces from the bit 304 to the departure device 302. The connector 306 may have one or more push loading areas, pull loading areas, torque loading areas, other loading areas, or some combination of the foregoing. In some embodiments, loading areas may be adjacent the bit 304 to receive downhole forces, uphole forces, and torque, respectively, from the bit 304 and/or the drill string (such as drill string 116 in FIG. 1). Downhole forces, uphole forces, and torque, respectively, may be transmitted from the connector 306 to the departure device 302 by one or more push transmission areas, pull transmission areas, or torque transmission areas that are optionally adjacent the departure device 302, and which may be included on the connector 306.

A connector 306 in accordance with embodiments of the present disclosure may be made of and/or include various materials. In some embodiments, the connector 306 may be made of and/or include a single material, while in other embodiments the connector 306 may include multiple materials. In some embodiments, a ratio between a yield strength of a material of the connector 306 and a yield strength of a material of the departure device 302 may be less than 1.0. In other words, when subjected to increasingly large forces, the material of the connector 306 may fail before the material of the departure device 302. In some embodiments, the ratio of the yield strength of a material of the connector 306 and a yield strength of a material of the departure device 302 may be less than 0.5. In yet other embodiments, the ratio of the yield strength of a material of the connector 306 and a yield strength of a material of the departure device 302 may be less than 0.42 or less than 0.45. For example, the connector 306 may be made of a first material having a yield strength equal to or less than half the yield strength of a second material of which the departure device 302 is made. In some embodiments, the connector 306 may be made of a material having a yield strength in a range having upper and lower values including any of 30, 40, 45, 50, 55, 60, 65, 70, 80 ksi, (205, 275, 310, 345, 380, 415, 450, 485, 550 MPa) or any value therebetween. For example, the connector 306 may be made of or include a material having a yield strength between 50 ksi and 70 ksi (345 MPa and 485 MPa). In another example, the connector 306 may be made of or include a material having a yield strength between 55 ksi and 65 ksi (380 MPa and 450 MPa). In at least one embodiment, the connector 306 may be made of or include aluminum bronze T9550 having a yield strength of 60 ksi (415 MPa), aluminum bronze C95400 having a yield strength of 32 ksi (220 MPa) and a Brinnel hardness of 170, or aluminum 7075-T7 having a yield strength of 63 ksi (435 MPa) and a Brinnel hardness of 135. In some embodiments, the connector 306 may be coupled to a whipstock of the departure device 202. The whipstock may be formed of or include a steel material (e.g., 4145 alloy steel having a yield strength of 120 to 140 ksi (825 to 970 MPa) and a Brinnel hardness of 208 to 340, tool steel, stainless steel, etc.), or other metals, alloys, ceramics, composite materials, natural/organic materials, or combinations of the foregoing. In some embodiments, the connector 306 may be formed of a material configured or otherwise designed to allow a bit to mill through the connector 306 more easily than the departure device 302. The connector 306 may be made of or include a first material that has a lesser yield strength and/or hardness than a second material in the departure device 302. The first material may be more easily removed by a bit or mill than the second material (e.g., by having a higher rate of removal, reduced loading to maintain a rate of removal, reduced wear in removing the material, etc.). For example, the first material may be bronze or aluminum bronze, and the second material may be steel. In some embodiments, the first material of the connector 306 may have a yield strength that, compared to the yield strength of the second material of the departure device 302, is within a range having lower and/or upper limits including any of 0.1, 0.25, 0.4, 0.45, 0.5, 0.6, 0.75, 0.8, or values therebetween, and a hardness that, compared to the hardness of the second material of the departure device 302 is within a range having lower and/or upper limits including any of 0.3, 0.5, 0.75, 0.8, 0.9, 0.95, or values therebetween.

In some embodiments, the volume, shape, and other configuration of the material of the connector 306 may allow the connector to remain coupled to the bit 304 and the departure device 302 during expected or potential downhole forces. For instance, the connector 306 may be capable of transmitting between 30 and 80 kilopounds (133 and 356 kN) of push-pull force. For instance, the connector 306 may withstand push-pull forces within a range having lower and/or upper limits that include any of 30, 40, 42, 44, 46, 48, 50, 52, 54, 56, 58, 60, 70, 80 kilopounds, (133, 178, 186, 195, 204, 212, 222, 230, 238, 245, 253, 261, 270, 311, 356 kN), or any value therebetween. For instance, the connector 306 may withstand applied push-pull forces in a range between 45 and 55 kilopounds (200 and 245 kN) or between 50 and 60 kilopounds (222 and 270 kN). In still other embodiments, the connector 306 may withstand forces less than 30 kilopounds (133 kN) or greater than 80 kilopounds (356 kN). In some embodiments, the shear pins 338 or other releasable fastener may release before failure of the body 344 of the connector 306. In some embodiments, the connector 306 may be capable of transmitting torque within a range having lower and/or upper limits that include any of 3.0, 5.0, 7.0, 7.5, 8.5, 10.0, 12.0, 15.0, 20.0 kilofoot-pounds (4.1, 6.8, 9.5, 10.2, 10.8, 13.6, 16.3, 20.3, 27.1 kN-m), or values therebetween. For instance, the connector may withstand applied torques of up to 7.5 kilofoot-pounds (10.2 kN-m), or between 5.0 and 10.0 kilofoot-pounds (6.8 and 13.6 kN-m). In other embodiments, the connector 306 may withstand torques less than 3.0 kilofoot-pounds (4.1 kN-m) or greater than 20.0 kilofoot-pound (27.1 kN-m). As will be appreciated in view of the disclosure herein, the forces on a downhole assembly may be affected by various factors, including the size of a wellbore. For instance, a smaller diameter downhole tool in a smaller diameter wellbore may be expected to have reduced forces when compared to a larger diameter downhole tool in a larger diameter wellbore. The above force-handling capabilities should therefore be understood to be illustrative only. For instance, such forces may be expected to be handled by a downhole tool in a wellbore or having a diameter between 8.5 in. (21.6 cm) and 10.75 in. (27.3 cm), e.g., for a downhole assembly having an outer diameter of 9.625 in. (24.4 cm). In other embodiments, the same or other loading may be expected in other-sized tools, or tools of such size may be expected to experience lower or higher loads.

As discussed herein, in at least some embodiments, the connector 306 may be a millable bit-to-whip connector. In general, it may be desired to minimize the amount of material in the connector 306 to reduce the amount of material to be milled or degraded by the bit 304 prior to formation of a lateral borehole. The amount of material or the shape or other configuration of the connector 306 may balance the desire for reducing the amount of material to be milled with the desired capabilities for handling push-pull and torque loads. In at least some embodiments, the amount of material to be milled may be increased beyond desired quantities in order to provide increased force-handling capabilities. The type of material forming the connector 306 may further be balanced with the volume of material and desired force-handling capabilities. For instance, by forming the connector 306 of a lower yield strength material as compared to the departure device 202, the amount of material to be milled and the force-handling capabilities may be balanced with the damage to the bit 304 and/or the mill time during milling of the connector 306.

In some embodiments, an operator may be able to detect a transition from when the bit is milling the connector 206 to when the bit contacts the departure device 302 and/or surrounding formation. The operator may detect changes in the torque at the bit in contact with material downhole. For example, the torque applied to the bit by the kelly and/or rotary table to rotate the bit may change when the bit or mill transitions from removing part of the connector 306 to contacting part of the departure device 302. In the same or other embodiments, the amount of weight-on-bit to cut casing or formation may be different than the amount of weight-on-bit used to mill the connector 306, or the rate of penetration may change.

Figure 4:
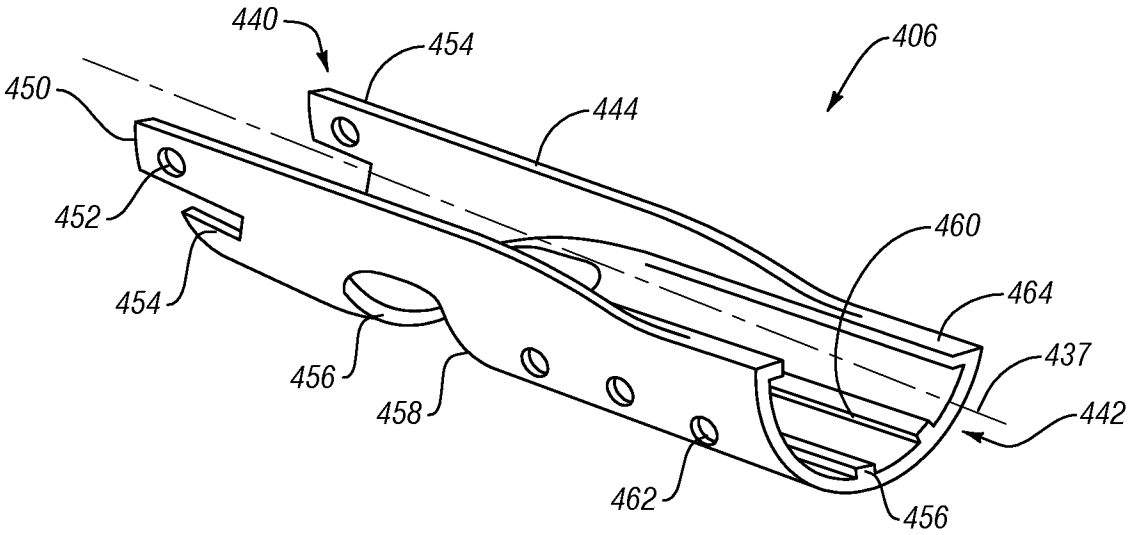
FIG. 4 is a top perspective view of a connector for coupling a departure device to a delivery mechanism, according to one or more embodiments of the present disclosure.

FIG. 4 is a top perspective view of a connector 406 in accordance with the present disclosure. Optionally, the connector 406 may be a millable connector configured or otherwise designed to be milled or otherwise degraded during a downhole operation. The connector 406 may include a body 444 that extends between a proximal end portion 440 and a distal end portion 442. In some embodiments, the body 444 may transmit force and/or torque co-axially with a longitudinal axis 437 of the body 444. Optionally, the body 444 may be distributed asymmetrically about the longitudinal axis 437. For example, the body 444 may couple to a first lateral side of a bit while not coupled to a second laterally opposed side of the bit (see, e.g., FIG. 6). In some embodiments, the body 444 may be distributed asymmetrically about the longitudinal axis 437 such that the body 444 extends around a portion of a perimeter around the bit or longitudinal axis 437. The body 444 may be square, rectangular, triangular, hexagonal, octagonal, polygonal, or irregularly shaped in lateral cross-section, and may be positioned about the longitudinal axis 437 to surround a portion of the perimeter that is in a range having upper and lower values including any of 35%, 40%, 45%, 50%, 55%, 60%, 65%, 70%, and any value therebetween. For example, the body 444 may surround between 40% and 70% of the perimeter about the longitudinal axis 437. In another example, the body 444 may surround between 45% and 65% of the perimeter about the longitudinal axis 437. In yet another example, the body 444 may surround between 50% and 60% of the perimeter about the longitudinal axis 437. In still other embodiments, the body 444 may surround less than 35% or greater than 70% of the longitudinal axis 437.

In at least one embodiment, the body 444 may have a generally semi-circular cross-section and/or a semi-cylindrical shape. For example, the body 444 may have a generally semi-circular lateral cross-section about the longitudinal axis 437. In some embodiments, the body 444 may have a lateral cross-section that is more or less than half of a circle (or which has another shape that is not a portion of a circle). For example, the body 444 may have a lateral cross-section that extends around a circumference of a circle in a range having lower and/or upper values including any of 35%, 40%, 45%, 50%, 55%, 60%, 65%, 70%, and any value therebetween. For example, the body 444 may have a lateral cross-section that extends between 40% and 70% of the circumference of a circle. In another example, the body 444 may have a lateral cross-section that extends between 45% and 65% of the circumference of a circle. In yet another example, the body 444 may have a lateral cross-section that extends between 50% and 60% of the circumference of a circle. In still other embodiments, the body 444 may have a lateral cross-section that extends less than 35% or greater than 70% of the circumference of a circle. Where the lateral cross-sectional shape is non-circular, the portion about which the cross-section extends may be determined using a circle which circumscribes the cross-section.

The connector 406 may receive downhole forces, uphole forces, and torque, respectively, from a bit, drill string, formation, casing, or the like. Forces from the bit and drill string may be received through at least one area and/or surface on the connector 406. The connector 406 may have loading areas configured to receive push, pull, or rotational forces. For example, the connector 406 may experience forces as described herein (e.g., more than 60 kilopounds (270 kN) of a downhole push force (compressive force coaxial with the longitudinal axis 437) and/or more than 7.5 kilofoot-pounds (10.2 kN-m) of rotational force (torque about the longitudinal axis 437) and/or less than 60 kilopounds (270 kN) of uphole pull force (tension force coaxial with the longitudinal axis 437)). The proximal end portion 440 of the connector 406 may have one or more push loading areas 450. A push loading area 450 may, in some embodiments, be axially-facing to receive a downhole force from a bit, BHA, or other component of a drill string. In some embodiments, the push loading area 450 is at the proximal end portion 440 of the body 444, and the push loading area 450 is at the proximalmost (or most uphole or nearest the surface) portion of the body 444. In other embodiments, the push loading area 450 is distal from the proximalmost portion of the body 444. In some embodiments, at least a portion of the push loading area 450 may lie in a plane normal to the downhole direction (i.e., perpendicular to the longitudinal axis 437). In other embodiments, at least a portion of the push loading area 450 may be at a non-right angle relative to the downhole direction (e.g., a v-shaped area may extending longitudinally to receive downhole forces on angled surfaces).

In some embodiments, the connector 406 may include one or more pull loading areas 452 that may be configured to receive an uphole force from the bit, BHA, or other drill string component. In some embodiments, at least one of the one or more pull loading areas 452 may have a longitudinally-oriented, axially-facing portion configured or otherwise designed to receive an uphole force from the bit, BHA, or drill string. As shown in FIG. 4, a pull loading area 452 may be a surface in an opening in the body 444. In some embodiments, a portion of the bit, BHA, or drill string may be positioned within the opening to apply an uphole force to the pull loading area 452. In other embodiments a shear element, such as that described in relation to FIG. 3, may be positioned within the opening and coupled to the bit, BHA, or drill string to apply an uphole force to the pull loading area 452. In at least some embodiments, the opening of the pull loading area 452 may be a radial opening. The radial opening may extend through a thickness of the body 444 at an angle perpendicular to or at a non-right angle relative to the longitudinal axis 437.

The connector 406 may have one or more torque loading areas 454 that may receive torque from a bit, BHA, or other drill string component. The torque loading areas 454 may include a face or surface oriented to receive torque applied to the torque loading area 454. In some embodiments, a torque loading area 454 may be on a laterally or rotationally-facing surface of the body 444 (e.g., a surface that is about parallel to, or which extends around, the longitudinal axis 437). One or more recesses or opening in the proximal end portion 440 of the connector 406 may border the torque-loading area 454. The recess and/or opening may be configured to receive a portion of the bit, BHA, or drill string therein, and surrounding surfaces may contact the bit, BHA, or drill string during rotation and/or torquing of the bit, BHA, or drill string.

One or more of the push loading areas 450, pull loading areas 452, or torque loading areas 454 may receive forces from the bit, BHA, or drill string, and the connector 406 may transmit forces to a departure device by one or more push (456), pull (458), or torque (460) transmission areas. In some embodiments, the connector 406 may include one or more fastener openings 462 in a portion of the body 444 proximate the distal end portion 442. The one or more fastener openings 462 may act as departure device couplings and may be configured or otherwise designed to receive fasteners to couple the connector 406 to the departure device. In some embodiments, a surface adjacent the fastener opening 462 may be a push transmission area 456, pull transmission area 458, or torque transmission area 460.

The one or more push transmission areas 456, pull transmission areas 458, or torque transmission areas 460 may transmit forces similarly to the receipt of forces by the one or more push loading areas 450, pull loading areas 452, or torque loading areas 454. In some embodiments, the push transmission areas 456 may be longitudinally oriented to transmit a downhole force to a departure device. In some embodiments, push transmission areas 456 may be located at the distal end portion 442 of the body 444 such that the push transmission area 456 is the distalmost portion of the body 444. In other embodiments, the push transmission areas 456 may be located proximally from the distalmost portion of the body 444. In some embodiments, at least a portion of the push transmission areas 456 may lie in a plane normal to the downhole direction (i.e., perpendicular to the longitudinal axis 437). In other embodiments, at least a portion of the push transmission areas 456 may be at a non-right angle relative to the downhole direction (e.g., a v-shaped area with surfaces to transmit downhole forces).

The connector 406 may include one or more pull transmission areas 458 that may be configured to transmit an uphole force to a departure device. In some embodiments, at least one of the one or more pull transmission areas 458 may have at least a portion or surface which is laterally oriented to transmit an uphole or pull force from the bit and/or drill string. As shown in FIG. 4, a pull transmission area 458 may be a laterally or circumferentially oriented surface around an opening in the body 444. In some embodiments, a portion of the bit, BHA, or drill string may be positioned within the opening to apply an uphole force to the connector, and the one or more pull transmission areas 458 may transmit the pull force to a surface thereof which is engaged with the departure device. In the same or other embodiments, a fastener or shear element, such as that described in relation to FIG. 3, may be positioned within the pull transmission areas 458 to apply an uphole force to the departure device.

The connector 406 may have one or more torque transmission areas 460 that may transmit torque to a departure device. The torque transmission areas 460 may include at least a portion oriented laterally to transmit a torque applied to the torque transmission areas 460. In some embodiments, one or more torque transmission areas 460 may be located on a lateral or circumferentially-facing surface of the body 444, such as a recess or opening in the proximal end portion 440 of the connector 406. The recess or opening may be configured to receive a portion of the departure device therein, and may the departure device during rotation or torquing of the bit, BHA, or drill string. In other embodiments, one or more torque transmission areas 460 may be located on one or more splines 464 located on the body 444 of the connector 406. The one or more splines 464 may mate complimentary with one or more recesses on a departure device to transmit torque to the departure device. In some embodiments, the connector 406 may include 2, 3, 4, 5, 6, or more splines 464 or torque transmission areas 460. In some embodiments, the one or more splines 464 or torque transmission areas 460 may be equally distributed on the body 444 to transmit torque evenly to the departure device. In other embodiments, the one or more splines 464 or torque transmission areas 460 may be unevenly spaced on the body 444 to allow higher torque transmission to selected portions of a departure device. In at least one embodiment, the splines 464 may be substantially parallel to the longitudinal axis 437. In another embodiment, the splines 464 may be helical.

Figure 5:
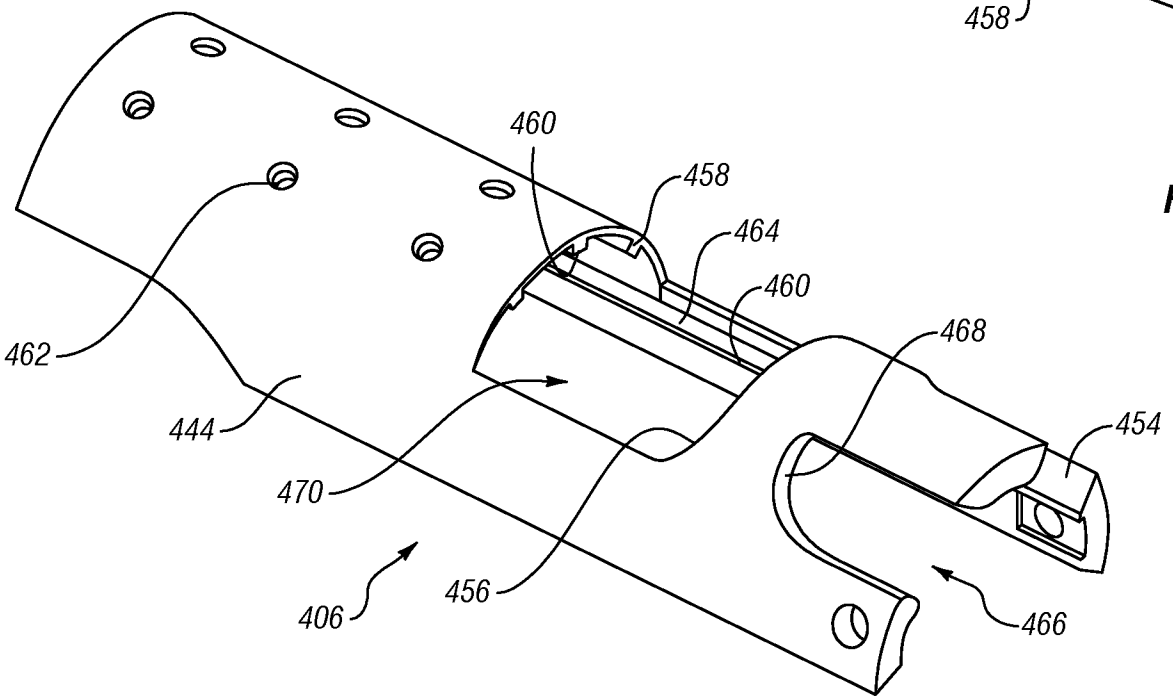
FIG. 5 is a bottom perspective view of the connector of FIG. 4, according to one or more embodiments of the present disclosure.

FIG. 5 is a bottom perspective view of a connector 406 in accordance with some embodiments of the present disclosure. As discussed briefly with respect to FIG. 4, the connector 406 may include one or more recesses 466 shaped, configured, or otherwise designed to receive blades of a bit, or other components of a BHA or drill string. The blades may apply force to one or more torque loading areas 454 that are oriented laterally adjacent the recesses 466. In some embodiments, the recesses 466 may have a curved surface 468 that may allow the rotation of a bit to apply a longitudinal shear force across a shear element (such as that described in relation to FIG. 3) to assist in disconnecting the connector 406 from the bit, BHA, or drill string. In other embodiments, the recesses 466 may be configured to receive another portion of the bit, BHA, or drill string.

A connector 406 may include one or more splines 464, such as those described in relation to FIG. 4, to provide torque transmission areas 460 to assist in the transmission of torque to a departure device. In some embodiments, a connector 406 may include one or more torque transmission areas 460 that are located on a laterally or circumferentially-facing surface of the body 444. In other embodiments, a connector 406 may include torque transmission areas 460 located within the body 444. For example, a torque transmission area 460 may be located at the perimeter of an opening 470 in the body 444, as depicted in FIG. 5. A connector 406 may include one or more openings 470 configured to receive at least a portion of a departure device and transmit torque thereto via one or more torque transmission areas 460. Similarly, the one or more openings 470 in the body 444 may allow the connector 406 to transmit uphole and/or downhole forces to the departure device by one or more pull transmission areas 458 and/or push transmission areas 456 on the perimeter of the one or more openings 470.

Still referring to FIG. 5, one or more fastener openings 462 may be configured or otherwise designed to receive fasteners or other departure device couplings to couple the connector 406 to the departure device. A surface adjacent the fastener opening 462 may be a push transmission area 456, pull transmission area 458, or torque transmission area 460, or the fastener may operate as a push, pull, or torque transmission area. In some embodiments, at least one of the fastener openings 462 may align with a portion of a spline 464. Alignment of a fastener opening 462 and a spline 464 may provide an additional volume of material surrounding the fastener opening 462. Additional material around the fastener opening 462 may enable a connection between the connector 406 and a departure device with a higher strength than using a fastener opening 462 with less material surrounding the fastener opening 462. In other embodiments, aligning a fastener opening 462 with a spline 464 may allow for simplified alignment of the fastener opening 462 with a corresponding attachment point on a departure device.

Figure 6:
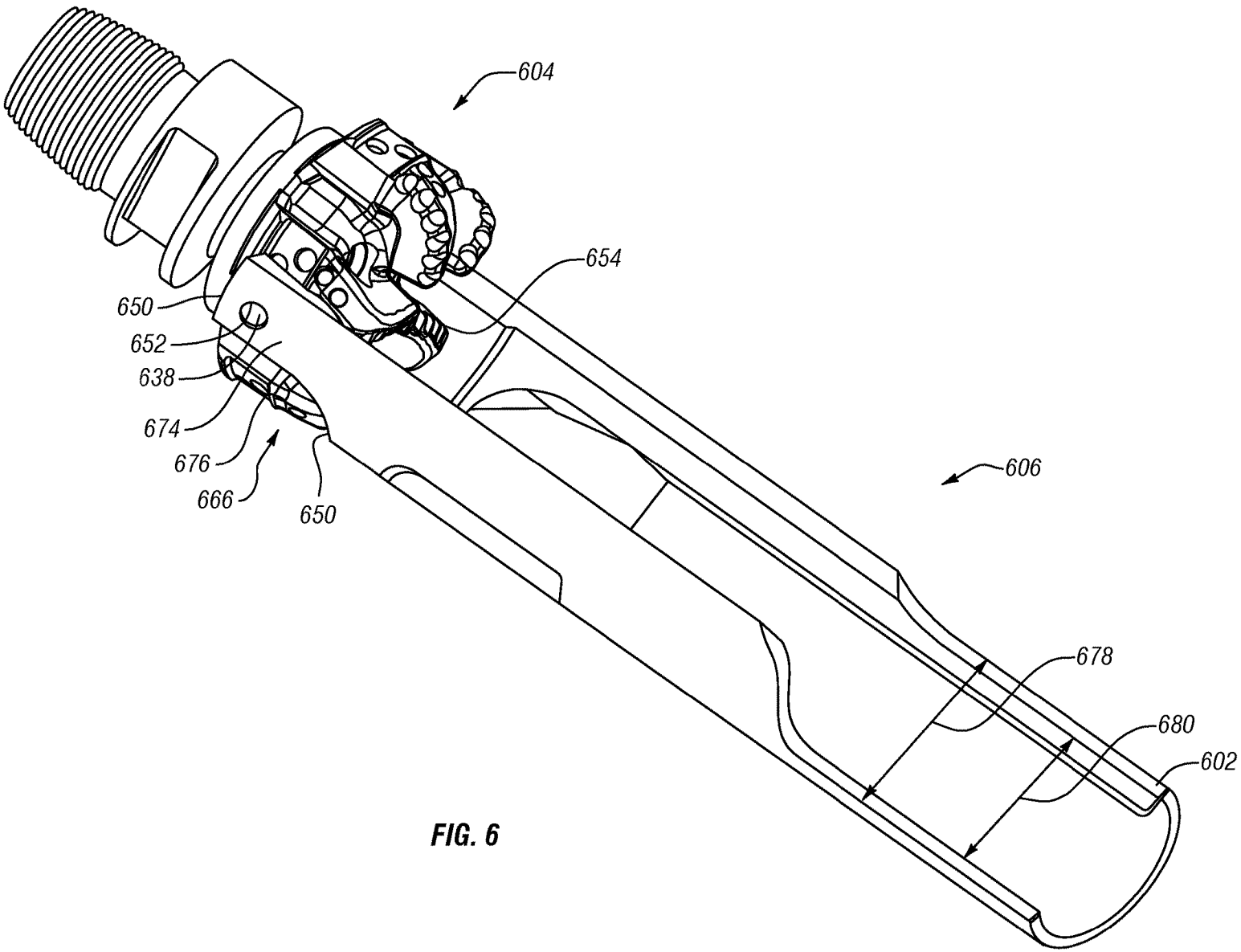
FIG. 6 is a bottom perspective view of a connector coupled to a bit and a departure device, according to one or more embodiments of the present disclosure.

Another embodiment of a connector 606 for coupling a bit 604 to a departure device 602 is depicted in FIG. 6. The connector 606 may be similar to or the same as the connector 404 described in relation to FIGS. 4 and 5. In some embodiments, the connector 606 may include extensions 674 spaced apart by recesses 666. The extensions 674 may include or define push loading areas 650 that may be configured to engage a bit 604, or may be configured to engage another portion (i.e., uphole from the bit) of the drill string (not shown). The recesses 666 may be configured to receive one or more bit blades 676 therein.

The push loading areas 650 of the connector 606 may be adjacent to a portion of the bit 604, BHA, or drill string prior to application of a force sufficient to release one or more shear elements or fasteners, such as shear pins 638. For example, the push loading areas 650 may receive an axial force from the bit 604, BHA, or drill string even in the absence of shear pins 638 or other fasteners coupling the bit 604 to the connector 606. The strength of the pull loading areas 652 adjacent the shear pins 638 may be limited by the shear strength of the shear pins 638. For example, the pull loading areas 652 may receive an uphole-directed pull force from the bit 604, BHA, or drill string that is equal to or less than the shear strength or shear rating of the shear pins 638. In some embodiments, the pull loading areas 652 may also receive downhole-directed push forces.

Torque loading areas 654 of the connector 606 may be adjacent a portion of the bit 604, BHA, or drill string prior to application of a force sufficient to release a fastener such as the shear pins 638. For example, the torque loading areas 654 may experience a rotational force from the bit 604, BHA, or drill string in the absence of shear pins 638 or other fasteners coupling the bit 604 to the connector 606. In some embodiments, the push loading areas 650 and torque loading areas 654 may experience greater forces, respectively, than the pull loading areas 652. As described herein, in some embodiments, the connector 606 may, without releasing from the bit 604 or departure device 602, receive more than 60 kilopounds (270 kN) of downhole force upon the push loading areas 650, more than 7.5 kilofoot-pounds (10.2 kN-3) of rotational force upon the torque loading areas 654, less than 60 kilopounds (270 kN) of uphole force upon the pull loading areas 652, or some combination of the foregoing. The pull loading areas 652 may be limited by the total threshold force of the one or more shear elements or fasteners. The push loading areas 650 and/or torque loading areas 654 may experience greater forces as there are no shear elements or fasteners transferring the force. In other words, the shear pins 638 and pull loading areas 652, the push loading areas 650, and the torque loading areas 654 may be configured or otherwise designed to handle expected downhole forces while tripping into a wellbore and positioning the departure device 602, and the shear pins 638 and pull loading areas 652 may be the weak links allowing release of the connector from the bit 604, BHA, or drill string upon anchoring or other positioning of the departure device 602.

FIG. 6 also depicts the connector 606 connected to a departure device 602. In some embodiments, the connector 606 may have a connector width 678 that is equal to or less than a departure device width 680. The departure device 602 may be sized and shaped to operate within a wellbore having particular dimensions. Optionally, the connector 606 may couple to the departure device 602 without causing the assembly to have a width greater than the departure device width 680 and/or a gauge diameter of the bit 604, or may otherwise reduce or even prevent interference with the operation of the departure device 602.

Figure 7:
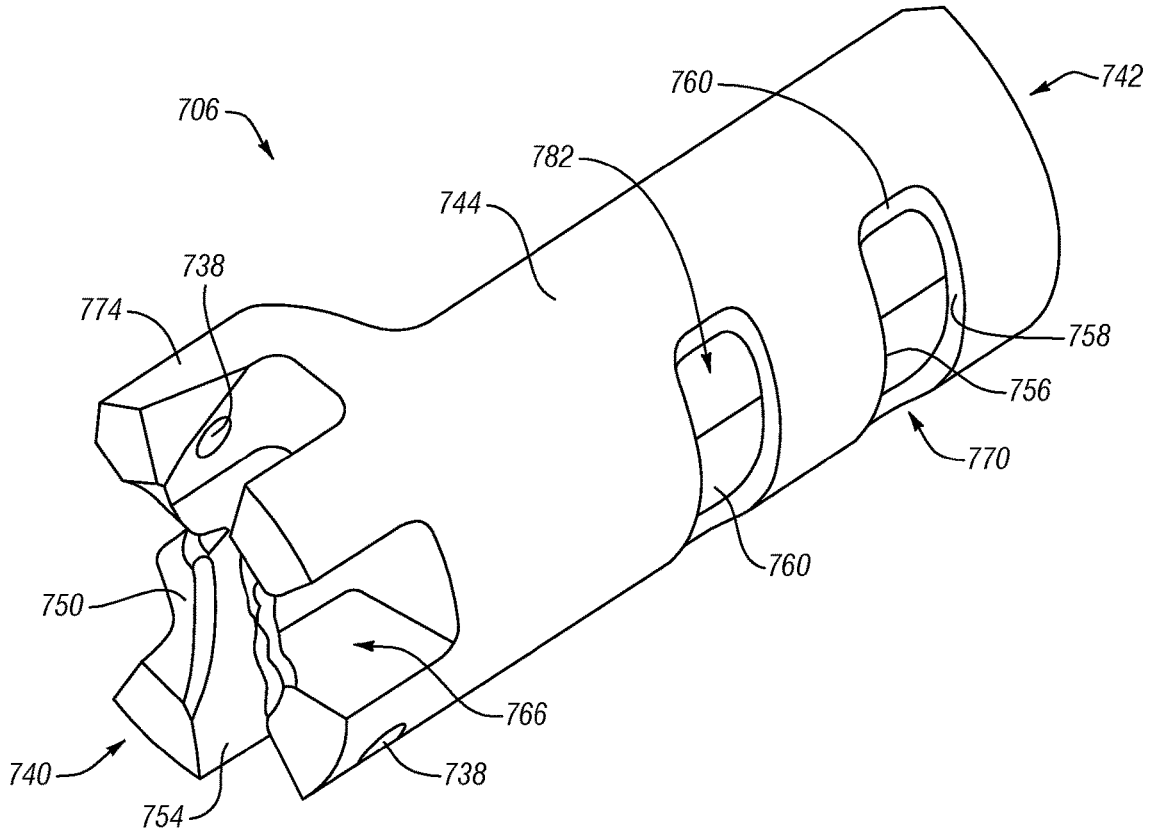
FIG. 7 is a cross-sectional perspective view of a connector having a closed body, according to one or more embodiments of the present disclosure.

FIG. 7 depicts another embodiment of a connector 706 in accordance with some embodiments of the present disclosure. The connector 706 may have a body with a proximal end portion 740 and a distal end portion 742. The proximal end portion 740 may be configured to mate with bit blades or other components of a bit face. For example, the proximal end portion 740 of the connector 706 may include one or more recesses 766 and/or one or more extensions 774. In some embodiments, the one or more recesses 766 and/or one or more extensions 774 may generally follow the longitudinal, helical, or other shape of a face of a bit such that a bit may contact one or more push loading areas 750 and/or one or more torque loading areas 754. Such contact may occur when a respective push or torque load is applied, or even in the absence of applied forces. The one or more recesses 766 and/or one or more extensions 774 may be machined, cast, forged, welded, brazed, or otherwise formed into the proximal end portion 740 of the connector 706 to provide a proximal end portion 740 that may mate with at least part of a bit. The one or more recesses 766 and/or one or more extensions 774 may also provide or define points, surfaces, or openings at which one or more shear elements 738 may couple the connector 706 to a bit.

In some embodiments, the distal end portion 742 of the connector 706 may include a substantially hollow portion of the body 744. The body 744 may include one or more openings extending radially and/or axially 770 therein. The one or more openings 770 may extend radially through the body 744 to a cavity 782 in the body 744. The cavity 782 may be open at the distal end portion 742 of the connector 706, which in some embodiments may allow at least a portion of a departure device to be inserted therein. A portion of the body 744 that defines the cavity 782 may include one or more push transmission areas 756, pull transmission areas 758, torque transmission areas 760, or a combination of the foregoing. Such areas may optionally be adjacent the one or more openings 770. A portion of a departure device may extend through at least part of one or more openings 770 and engage with one or more push transmission areas 756, pull transmission areas 758, or torque transmission areas 760.

Figure 8:
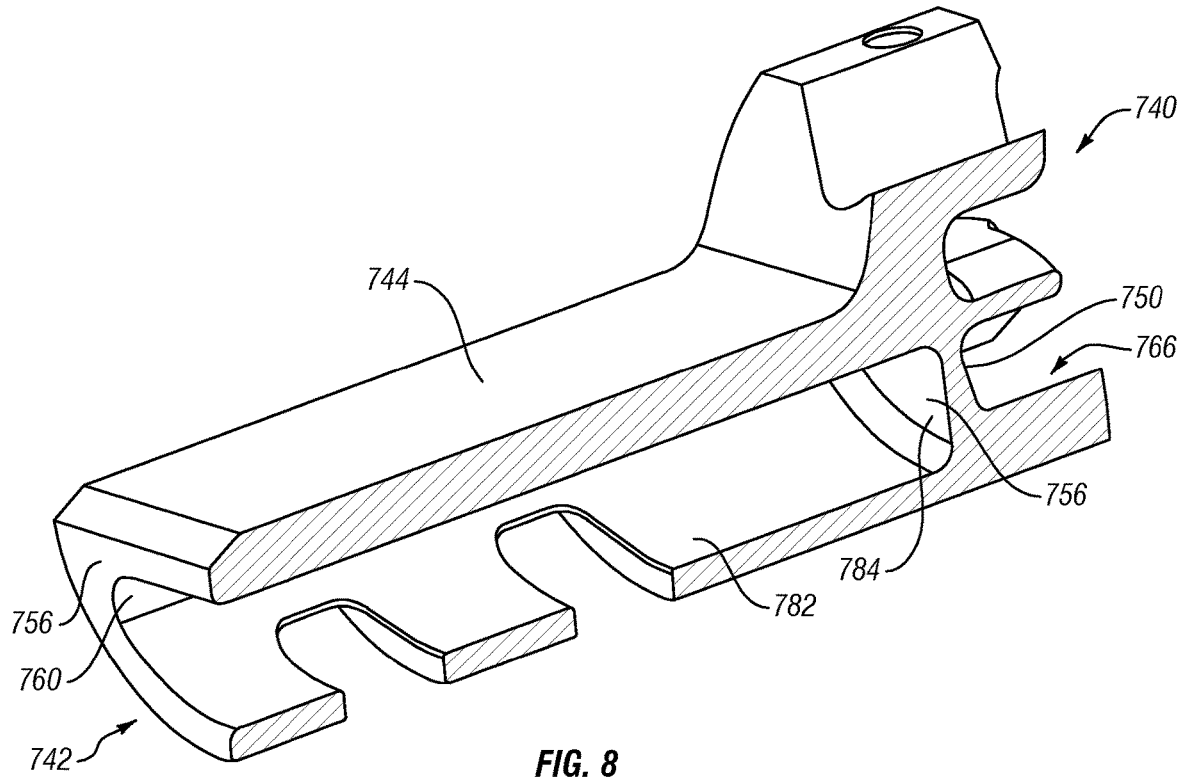
FIG. 8 is a partial cross-sectional, bottom perspective view of the connector of FIG. 7, according to one or more embodiments of the present disclosure.

As shown in FIG. 8, the 782 may be open at a distal end portion 742 of the body 744 and extend from the distal end portion 742 in a longitudinal direction toward the proximal end portion 740. The cavity 782 may extend longitudinally to a partition 784 in body 744. The partition 784 may separate the cavity 782 from one or more recesses 766 at the proximal end portion 740 of the connector 706. The partition 784 may include one or more push loading areas 750 on a proximal side of the partition 784 and one or more push transmission areas 756 on a distal side of the partition 784. For example, a portion of a departure device may be inserted through a full length of the cavity 782 and may contact the partition 784. The body 744 may have one or more torque transmission areas 760, which may transmit torque to a departure device inserted into the cavity 782 and which contact the body 744 along the side of the cavity 782.

Figure 9:
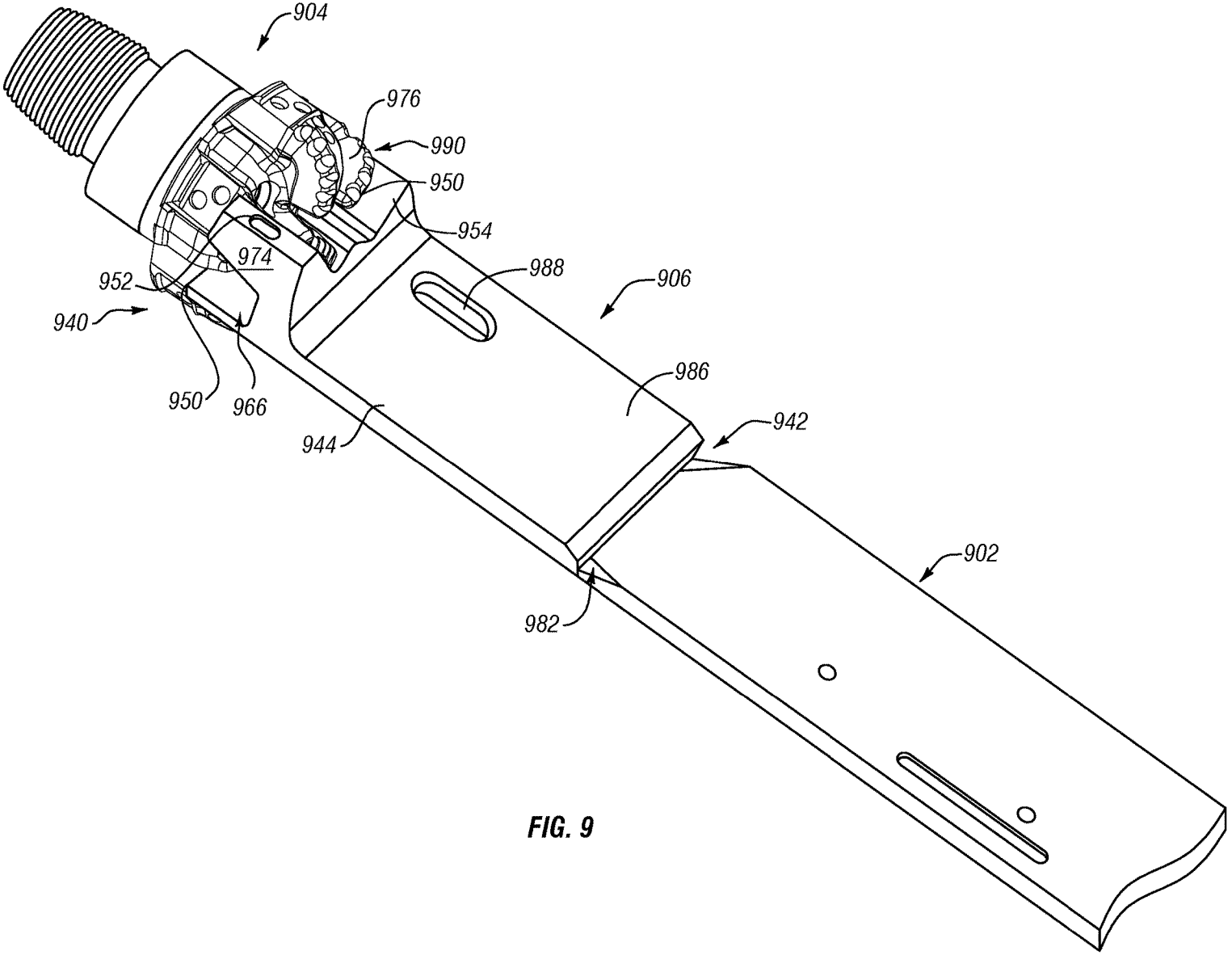
FIG. 9 is a top perspective view of a connector having a closed body coupled to a bit and a departure device, according to one or more embodiments of the present disclosure.

FIG. 9 depicts a connector 906 coupling a bit 904 to a departure device 902. The connector 906 may be similar to or the same as the connector 706 described in relation to FIGS. 7 and 8. The departure device 902 may be at least partly inserted into a cavity 982 of the connector 906. A body 944 of the connector 906 may have a support face 986 that extends a full or partial length of the cavity 982 from the distal end 942. The support face 986 may provide support to the body 944 during force transmission from the bit 904 to the departure device 902. In some embodiments, the support face 986 may be substantially solid and continuous. In other embodiments, the support face 986 may have one or more openings 988. The one or more openings 988 may, in some embodiments, allow access to the cavity 982 and/or the departure device 902 within the cavity 982. In further embodiments, the support face 986 may extend a full length of the cavity 982 or more. In yet further embodiments, the support face 986 may extend a length less than the length of the cavity 982. For example, the support face 986 may terminate at an opening 988 that is a full width of the cavity 982. In some embodiments, the support face 986 may limit or, in some cases, substantially prevent rotational movement of a departure device 902 relative to the connector 906 when a portion of the departure device 902 is located in the cavity 982.

In some embodiments, a proximal end portion 940 of the connector 906 may cover or extend around a portion of a bit face 990 having one or more bit blades 976. In other embodiments, the proximal end portion 940 may cover or extend around the entire bit face 990. For example, a the proximal end portion 940 of the connector 906 may be configured to complimentarily mate with at least a portion of the bit face 990 and receive one or more bit blades 976 into one or more recesses 966. At least one of the recesses 966 may have a push loading area 950, a torque loading area 954, a pull loading area 952, or combinations thereof. For example, at least one of the recesses 966 may have a push loading area 950 on an a surface adjacent thereto (e.g., a surface at a distal end of the recess 966 and/or adjacent a proximal end of the recess 966). A torque loading area 954 may also be adjacent the recess 966, such as on an axial surface defining or adjacent the recess 966. In some embodiments, a transverse cross-section of the proximal end portion 940 of the connector 906 may cover, enclose, or mate with at least 50% of a transverse cross-sectional area of the bit face 990. As shown in FIG. 9, for instance, various lets or extensions 974 may be angularly or circumferentially offset from each other, with recesses 966 therebetween. In some embodiments, the extensions 974 may substantially fill a circumferential or angular gap or junk slot between bit blades 976. The extensions 974 and recesses 966 may extend around approximately 215° of a circle, or around about 60% of the circle and the bit face 990. The proximal end portion 940 may extend around the bit face 990 in lesser or greater percentages in other embodiments. For instance, a transverse cross-section of the proximal end portion 940 of the connector 906 may cover, enclose, or mate with at least 30% (e.g., 110°), 40% (e.g., 145°), 60% (e.g., 215°), 75% (e.g., 270°), 80% (e.g., 290°), 90% (e.g., 325°), or 95% (e.g., 340°) of a transverse cross-sectional area of the bit face 990. In further embodiments, a transverse cross-section of the proximal end portion 940 of the connector 906 may cover, enclose, or mate with substantially a full transverse cross-sectional area of the bit face 990. As will be appreciated by those skilled in the art having the benefit of the present disclosure, increasing the coverage of the proximal end portion 940 around bit face 990 may, in some embodiments, cause an increase an amount of material of the connector 906 to be milled prior to performing a wellbore departure operation, rather than decrease or minimized amount of material to be milled.

Figure 10:
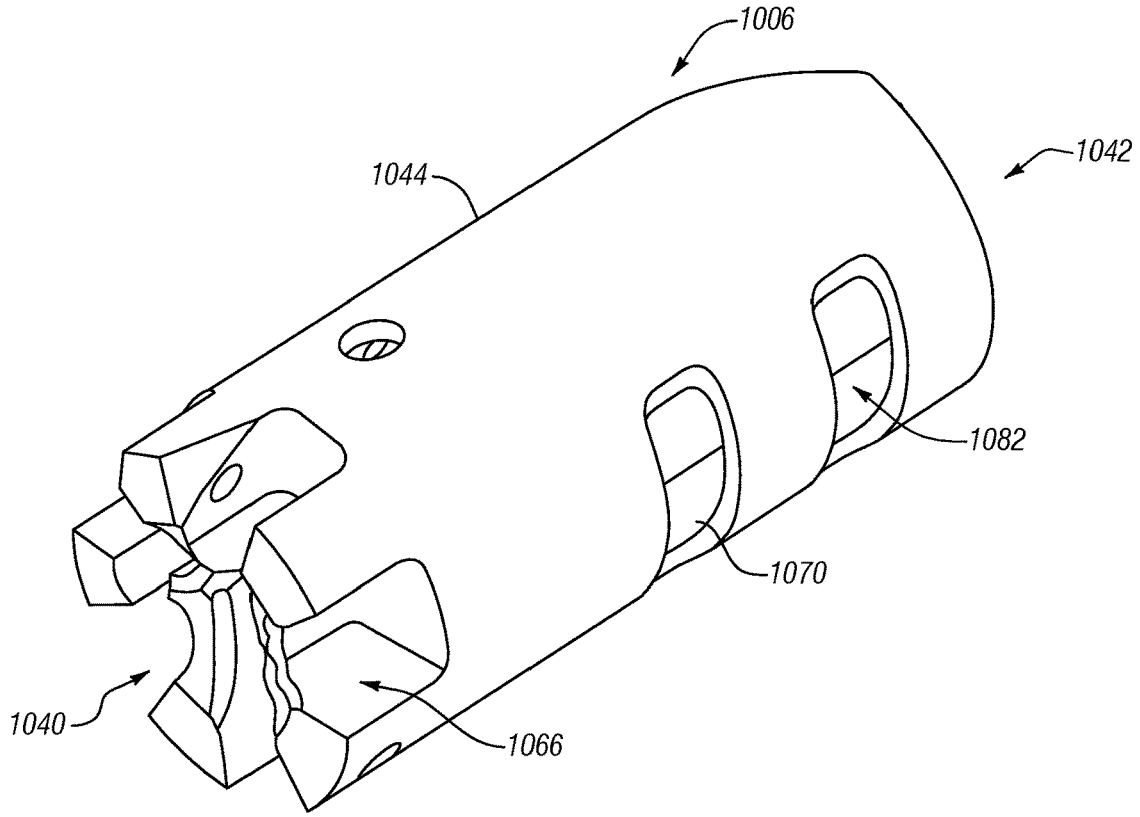
FIG. 10 is a top perspective view of a connector having a generally cylindrical body, according to one or more embodiments of the present disclosure.

A connector 1006 may have a body 1044 that is substantially cylindrical, as shown in FIG. 10. The connector 1006 may have a proximal end portion 1040 and a distal end portion 1042. In some embodiments, the proximal end portion 1040 may cover or extend around a full circumference of the cylindrical body 1044 and/or the bit 1004. In other embodiments, the proximal end 1040 may cover or extend around less than the full circumference of the cylindrical body 1044 and/or the bit 1004. The proximal end portion 1040 may have one or more recesses 1066 therein to mate with a bit face (similar to that depicted in FIG. 9). The one or more recesses 1066 may include, be defined at least partially by, or be adjacent one or more push loading areas, torque loading areas, or pull loading areas, as described herein, including areas similar to those described FIGS. 5 and 9.

Figure 11:
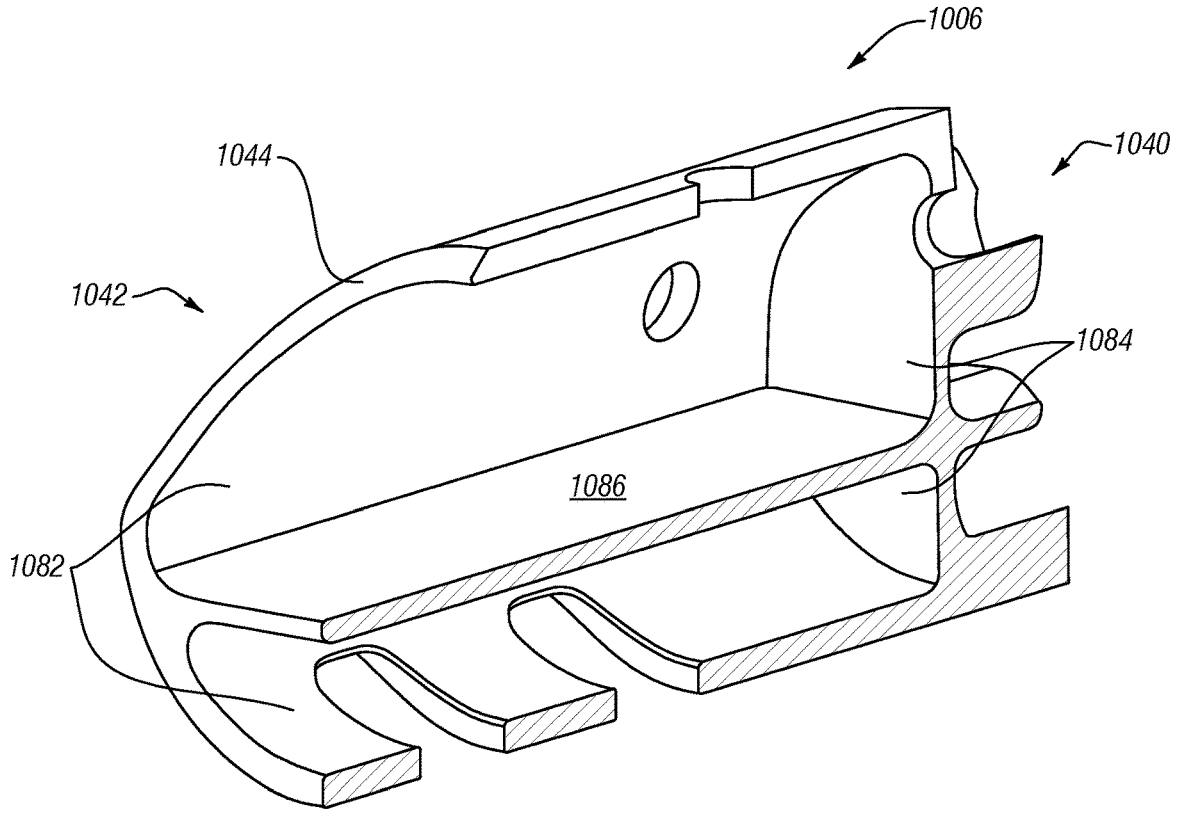
FIG. 11 is a cross-sectional bottom perspective view of the connector of FIG. 10, according to one or more embodiments of the present disclosure.

In some embodiments, the distal end portion 1042 of the body 1044 may be at least partially open, allowing access to at least one cavity 1082. In other embodiments, the distal end portion 1042 of the body 1044 may be closed, sealing at least a portion of the cavity 1082 (or there may be no cavity 1082). For example, an open distal end portion 1042 of the body 1044 may allow for increased removal rates of the connector 1006 when a bit or mill removes material therefrom by virtue of less material being present. A closed distal end 1042 may reduce interactions (e.g., catching on) between the connector 1006 and a wall of an uncased wellbore. In some embodiments, the body 1044 may have one or more openings 1070 extending radially therethrough that extend from an outer surface of the body 1044 to the at least one cavity 1082 or bore within the body 1044. As shown in FIG. 11, in some embodiments, the connector 1006 may have a body 1044 having a plurality of cavities 1082 therein. The plurality of cavities 1082 may be open at a distal end (e.g., catching on) 1042 of the connector 1006 and may extend to a partition 1084 at or near the proximal end portion 1040 of the connector 1006. The partition may separate the cavities 1082 (extending longitudinally from the distal end (e.g., catching on) 1042) from the proximal end (e.g., catching on) 1040 of the connector 1006. The plurality of cavities 1182 may be separated by a support face 1086. In some embodiments, the support face 1086 may transfer axially directed forces, such as a downhole (compressive/push) or uphole (tension/pull) forces as described in relation to FIG. 4, between the proximal end portion 1040 and the distal end portion 1042 of the connector 1006 and, therefore, from a delivery mechanism to a departure device. In other embodiments, the support face 1086 may increase the torsional strength of the body 1044. For example, the support face 1086 may provide a lateral bracing across the body 1044 to increase the resistivity of the connector 1006 to buckling under compression or torsion. While the support face 1086 is shown as being generally planar and extending axially within the body 1044, one or more support faces may have other structures. For instance, support structures may include internal ribs, helical faces, or other support structures that separate or define cavities, pockets, grooves, slots, or the like. In general, a support face or other support structure may provide structural integrity to the body 1044 when the body 1044 is not a solid mass of material.

Figure 12:
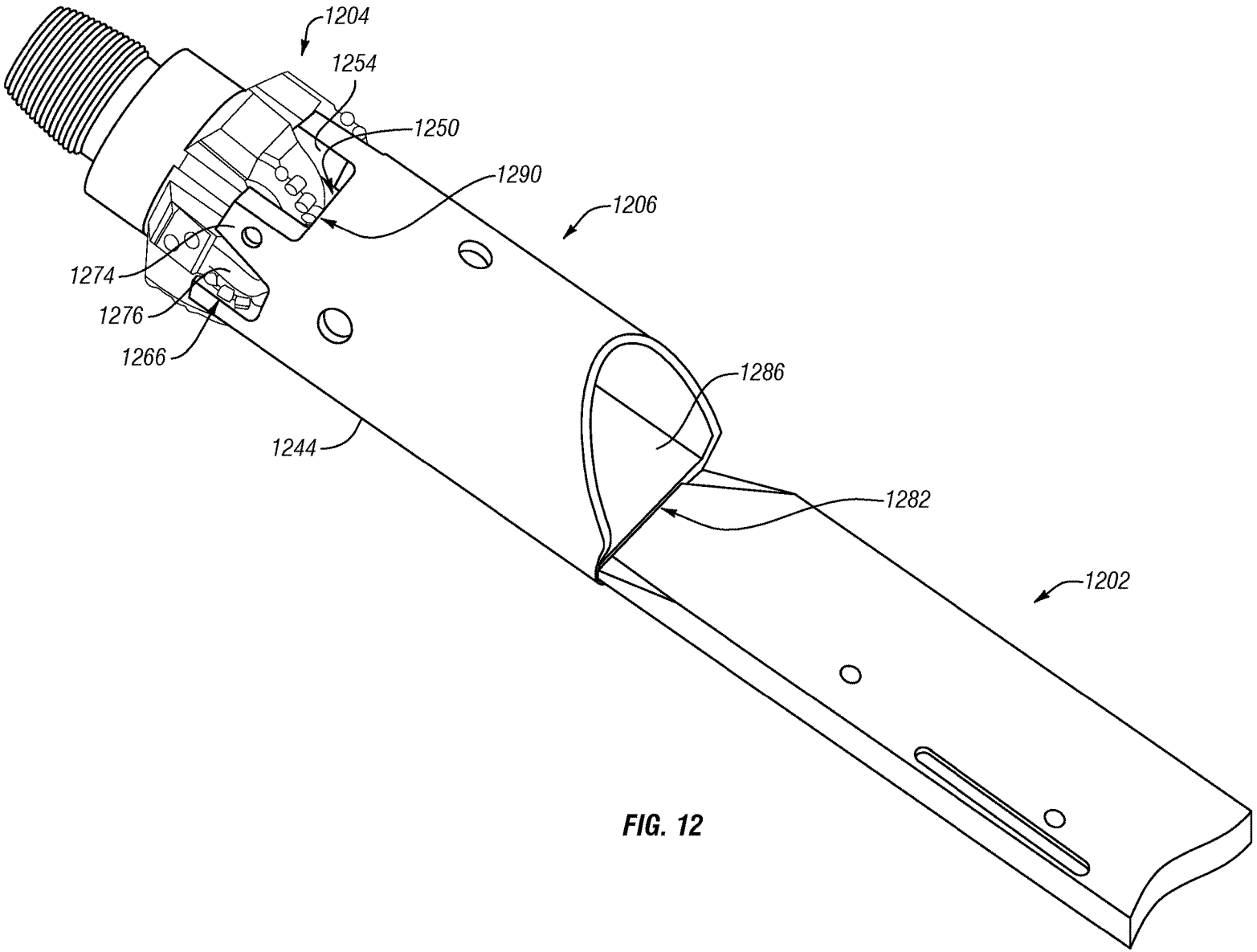
FIG. 12 is a top perspective view of a connector having a generally cylindrical body coupled to a bit and a departure device, according to one or more embodiments of the present disclosure.

As shown in FIG. 12, in some embodiments, a support face 1286 may located within a cylindrical body 1244 such that the support face 1286 may limit or, in some cases, substantially prevent rotational movement of a departure device 1202 relative to a connector 1206. In some embodiments, the support face 1286 may limit rotational movement when a portion of the departure device 1202 is located in a cavity 1282, although in other embodiments a support structure may limit rotational movement by being positioned within the departure device 1202 or adjacent thereto. Also shown in FIG. 12, in some embodiments, the connector 1206 may be configured to complimentarily mate with a bit face 1290. A plurality of recesses 1266 may each be configured to receive a bit blade 1276 and/or a plurality of extensions 1274 may extend in a proximal (uphole) direction between the bit blades 1276, similar to as described in relation to FIG. 7. The plurality of recesses 1266 and/or extensions 1274 may have one or more push loading areas 1250 and one or more torque loading areas 1254. In at least one embodiment, a connector 1206 having a generally cylindrical body 1244 may be able to withstand higher forces than a connector according to FIGS. 3-9, even with similar volumes of body material.

Figure 13:
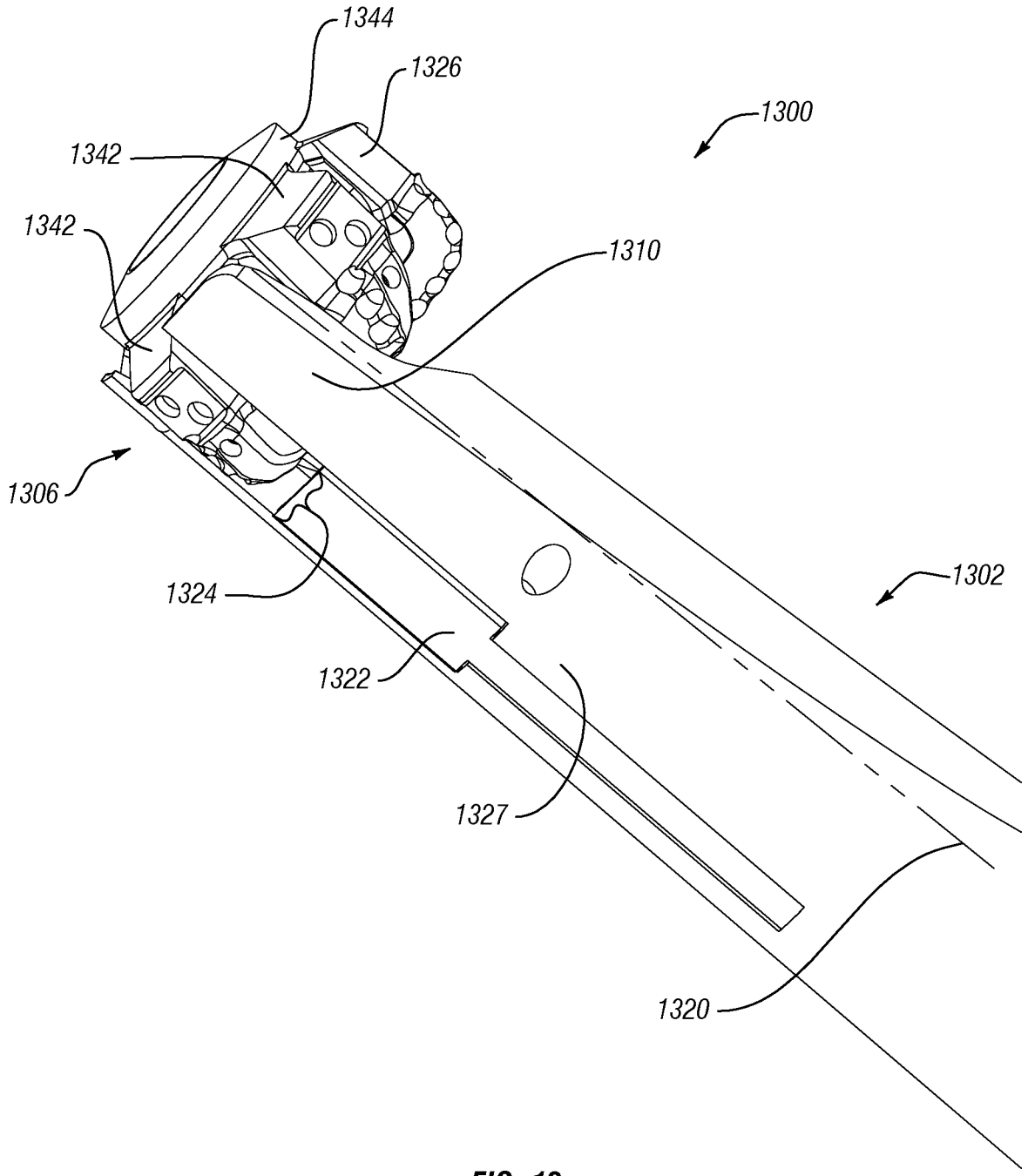
FIG. 13 is a perspective view of a bit coupled to a departure device, according to one or more embodiments of the present disclosure.

FIG. 13 illustrates another embodiment of the present disclosure, and shows an example departure device 1300 having two connection members 1310 coupled to a bit 1326 at connector 1306. In some embodiments, the connection members 1310 may connect to the bit 1326 in a junk slot between blades 1342. The connection members 1310 may extend between the blades 1342. For example, as depicted in FIG. 13, the connection members 1310 may fully or partially fill the angular space between the blades 1342. In at least some embodiments, the connection members 1310 may be positioned within the junk slot between blades 1342 while not extending radially outward relative to the gauge of the bit 1326. In other embodiments, the connection members 1310 may extend radially outward beyond the gauge of the bit 1326. The connection members 1310 may contact or engage a bit body 1344 and in some embodiments may contact/engage the blades 1342 on one or both lateral sides of the connection members 1310.

In another example, the connection members 1310 may occupy a portion of the junk slot or other angular space between the blades 1342 without contacting the blades 1342. For instance, a connection point between the connection members 1310 and the bit 1326 may be on either or both laterally-facing sides of the adjacent blades 1342. In other embodiments, the connection members 1310 may extend longitudinally uphole, past the blades 1342. In such embodiments, the connection members 1310 may connect to the bit 1326 at a bit body 1344. For example, the connection members 1310 may extend past the blades 1342 and connect to a collar, a steerable portion (e.g., a rotary steerable system), a BHA, or other component uphole of the bit 1326. In some embodiments, a connection to a delivery mechanism uphole of the bit 1326 may enable a greater application of force to the departure device 1300 from the delivery mechanism. For example, a connection to a delivery mechanism above the bit 1326 may provide a longer lever arm over which the force may be applied to direct and guide the departure device 1300.

FIG. 13 depicts a movable member 1322 located within the whipstock body 1318 and movable with respect thereto. In this particular embodiment, the movable member 1322 may move longitudinally within the whipstock body 1318. Optionally, the movable member may selectively apply a force to the connector 1306. While a single movable member 1322 is illustrated in FIG. 13, in other embodiments, the departure device may include a plurality of movable members 1322. In some embodiments, the movable member 1322 may move from or between a retracted position and an extended position.

FIG. 13 illustrates a departure device 1300 having a movable member 1322 in a retracted (i.e., pre-deployed) position. In the retracted position, the movable member 1322 may be located fully or partially inside an outer surface 1327 of the whipstock body 1318 (e.g., in a radial and/or longitudinal direction). For example, the whipstock body 1318 may define an outermost envelope or surface and the movable member 1322 may remain within this envelope. In another embodiment, at least a portion of the movable member may extend radially or longitudinally beyond the outer surface 1327 and/or envelope of the whipstock body 1318.

According to some embodiments of the present disclosure, the movable member 1322 may move within and/or along a longitudinal channel 1324 defined within the whipstock body 1318. As shown, the longitudinal channel 1324 may be located between the two (2) adjacent connection members 1310 connected to the bit 1326, and may extend longitudinally along a portion of the whipstock body 1318. In other embodiments, the path of the movable member 1322 may be outside of the longitudinal channel 1324 defined between the connection members 1310.

In some embodiments, a surface of the movable member 1322 may align coherently with an outer surface 1327 of the whipstock body 1318 when in the deployed and/or pre-deployed state. As used herein, "align coherently" should be understood to mean that two or more surfaces may substantially form a single surface that, aside from a seam between the two components in the surface, appears and functions substantially similarly to a single, continuous surface. The single surface may be a curved surface, a flat surface, or a partially curved and partially flat surface. In other embodiments, the movable member 1322 may be recessed or otherwise offset from the outer surface 1327. In further embodiments, the movable member 1322 may have a flat surface and the outer surface 1327 may be curved in the region surrounding the movable member 1322. In yet further embodiments, at least a portion of the movable member 1322 may extend outside the outer surface 1327.

Figure 14:
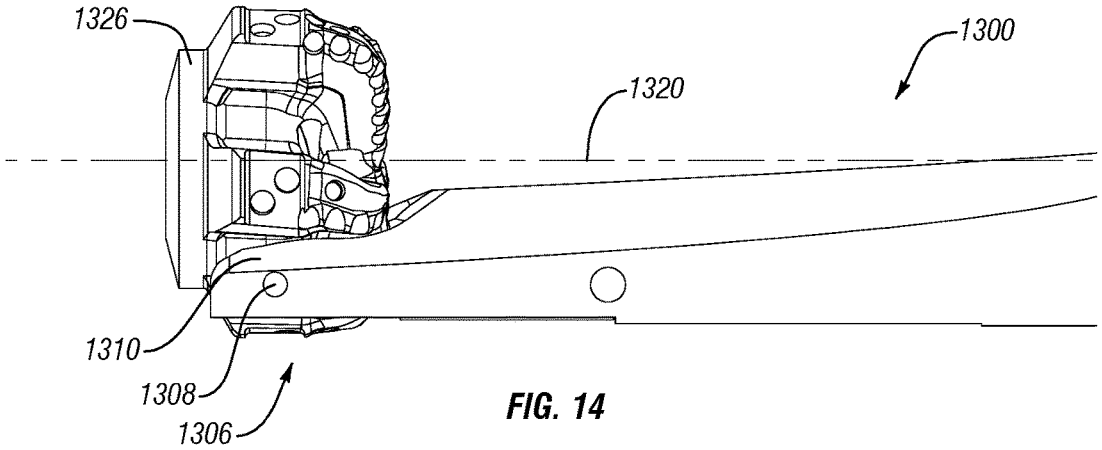
FIG. 14 is a side view of the bit and departure device shown in FIG. 13, according to one or more embodiments of the present disclosure.

FIG. 14 is a side view of the embodiment of the bit 1326 and departure device 1300 of FIG. 13. The departure device 1300 may include or be coupled to the connector 1306, which may extend between and couple the bit 1326 and the departure device 1300. The connector 1306 may include a shear pins 1308 or other shear elements that may provide a connection structure between the bit 1326 and the connection members 1310. In some embodiments, the shear pins 1308 may be oriented such that they are substantially perpendicular to the longitudinal axis 1320 of the departure device and, in the depicted embodiment, to the path of travel of the movable member 1322 (see FIG. 13). In other embodiments, the connector 1306 may be otherwise oriented, or may include other fasteners, such as bolts, screws, clamps, collars, press fit fasteners, snap fit fasteners, adhesives, welds, other fasteners, or combinations of the foregoing.

The connection members 1310 may be coupled to the bit 1326 by using a breakable fastener such as the shear pins 1308. The whipstock 1302 may include a whipstock body 1318 from which the connection members 1310 extend. The whipstock body 1318 may be an elongate body that may fit within the primary wellbore. The connection members 1310 may be formed integrally with the whipstock body 1318, or may be formed separately and then coupled thereto.

In some embodiments, at least a portion of the whipstock body 1318 may be generally cylindrical. For example, the downhole or distal-most portion (not shown) of the whipstock body 1318 may be generally cylindrical. In other embodiments, at least a portion of the whipstock body 1318 may have a regular polygonal transverse cross-sectional shape including a triangle, rectangle, pentagon, hexagon, or so forth. In yet other embodiments, the at least a portion of the whipstock body 1318 may be irregularly shaped in transverse cross-section.

Figure 15:
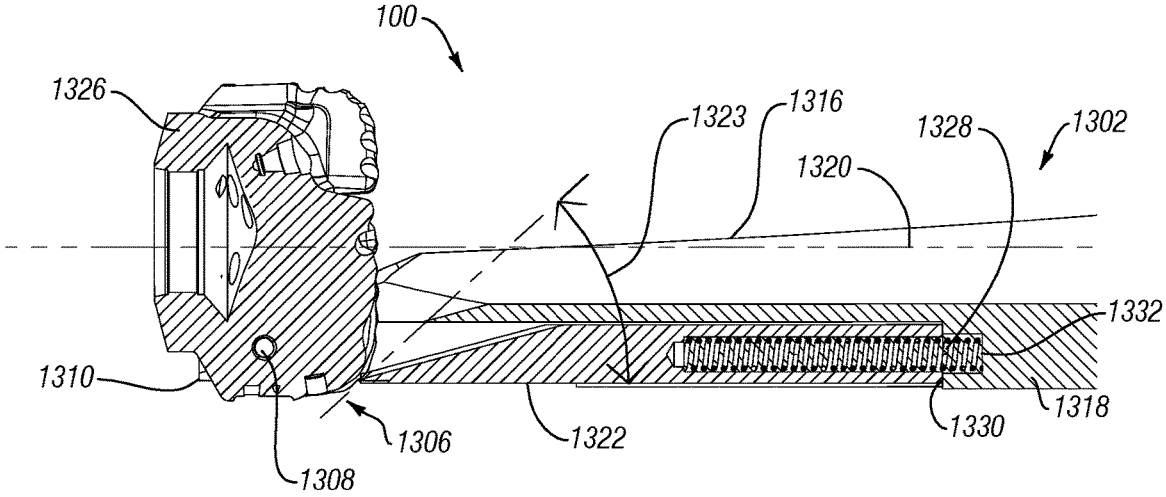
FIG. 15 is a cross-sectional side view of the bit and departure device of FIG. 13, with the departure device including a retracted movable member, according to one or more embodiments of the present disclosure.

Referring now to FIG. 15, the whipstock 1302 may have a sloped surface 1316 that extends along the whipstock body 1318 at one or more angles relative to a longitudinal axis 1320 of the whipstock body 1318. The sloped surface 1316 may be configured to direct the bit 1326 toward the side of a primary wellbore for initiating formation of a lateral borehole. The sloped surface 1316 may extend at a constant angle or slope, or may have multiple segments at different angles or slopes relative to the longitudinal axis 1320. The sloped surface 1316 may also have any of various profile shapes or contours. For instance, the sloped surface 1316 may be planar, arcuate, have various other shapes, or have a combination of the foregoing. The relative angle of a lateral borehole 232 (see FIG. 2) relative to a primary wellbore 208 (see FIG. 2) may be related to the angle and shape of the sloped surface 1316 of the departure device 1300.

In some embodiments, a surface of the movable member 1322 may align coherently with the sloped surface 1316. In other words, the movable member 1322 and the sloped surface 1316 may have surfaces that together function substantially as a single surface. More particularly, a surface of the movable member 1322 may align with the sloped surface 1316 such that the sloped surface 1316 appears and functions substantially similarly to a single surface upon which the bit 1326 may travel. The movable member 1322 and the sloped surface 1316 may align coherently while the movable member 1322 is in a retracted (pre-deployed) position and/or in an extended (deployed) position. For instance, as the movable member 1322 moves within the longitudinal channel 1324, the movable member 1322 may remain coherently aligned with the sloped surface 1316. In such embodiments, the longitudinal channel 1324 may be formed as a slot within the sloped surface 1316. Optionally, the movable member 1322 may include a ramped or angled face to align coherently with the sloped surface 1316. In another example, movable member 1322 may be coherently aligned with the sloped surface 1316 at least while the movable member 1322 is in an extended (deployed) position. In such embodiments, the longitudinal channel 1324 (see FIG. 13) between the longitudinal connection members 1310 may become closed-off at the proximal or uphole end to provide a coherent sloped surface 1316 at a point where the bit 1326 may first engage the departure device 1300. As a result, as the bit 1326 then begins to engage the departure device 1300, the sloped surface 1316 and the movable member 1322 may collectively support the bit 1326. In at least one embodiment, a coherent sloped surface 1316 upon which the bit 1326 may travel may reduce damage to the bit 1326 and/or the departure device 1300. In at least another embodiment, a coherent sloped surface 1316 may guide a bit 1326 during the creation of a lateral borehole.

In some embodiments, at least part of the sloped surface 1316 may be contoured or otherwise varied to receive and direct the bit 1326 in the formation of a lateral borehole and/or casing window. For instance, the sloped surface 1316, if viewed in a transverse cross-section formed by a plane perpendicular to the longitudinal axis 1320, may be linear or may be concave. A concave sloped surface 1316 may be curved in a manner that generally corresponds to a curve of the bit 1326. The sloped surface 1316 may also have various additional contours. For instance, if viewed in a cross-section formed by a plane parallel to the longitudinal axis 1320, a full or partial length of the sloped surface 1316 may have a constant slope relative to the longitudinal axis 1320. Such a slope may be linear, and in some embodiments, may provide for constant entrance angle into the lateral borehole. In the same or other embodiments, at least a portion of the length of the sloped surface 1316 may have a different contour. For instance, the slope of the sloped surface 1316 may change (e.g., increase or decrease), and the sloped surface 1316 may have multiple linearly sloped portions. In still other embodiments, a portion of the sloped surface 1316 may have a non-linear slope along its length. In some embodiments, at least part of the sloped surface 1316 may have an increasing slope relative to the longitudinal axis 1320. An increasing slope may define a curved longitudinal path upon which the bit 1326 may travel. For example, a curved sloped surface 1316 having an increasing slope may curve away from the longitudinal axis 1320 and provide for an increasingly rapid entrance into the lateral borehole 232 (see FIG. 2). In other embodiments, at least part of the sloped surface 1316 may have a decreasing slope relative to the longitudinal axis 1320 of the whipstock body 1318. A curved sloped surface 1316 having a decreasing slope, in some embodiments, may provide for increased clearance between the bit 1326 and the sloped surface 1316 by allowing the sloped surface 1316 and bit 1326 to move apart from one another as the bit 1326 is advanced relative to the sloped surface 1316. For example, increased clearance near the entrance to the lateral borehole may reduce complications during operation from interactions between the bit 1326 and the whipstock 1302. In another embodiment, clearance between the bit 1326 and the sloped surface 1316 may provide additional space for the removal of debris during removal of material during drilling or milling.

In still further embodiments, a portion of the sloped surface 1316 may have a constant slope, an increasing slope, a decreasing slope, other varying slopes, or combinations thereof. For example, an uphole or proximal-most portion of the sloped surface 1316 may have a decreasing slope, an intermediate portion of the sloped surface 1316 may have a constant slope, and a downhole or distal-most portion of the sloped surface 1316 may have an increasing slope. In such an example, the sloped surface 1316 may facilitate a steeper entrance into the lateral borehole.

As discussed herein, the sloped surface 1316 may also have various shapes in the transverse direction. In some embodiments, at least part of the sloped surface 1316 may be planar. In other embodiments, at least part of the sloped surface 1316 may be concave. In yet other embodiments, at least part of the sloped surface 1316 may be convex. For example, a sloped surface 1316 having a concave surface in the transverse direction may form a trough-like structure that may restrict lateral motion of the bit 1326 when starting the lateral borehole. The contour of the sloped surface 1316 may, in some embodiments, generally correspond to the shape or gauge of the bit 1326. In another example embodiment, a sloped surface 1316 having a convex surface in the transverse direction may provide additional space between the bit 1326 and the lateral portions of the sloped surface 1316. In particular, a convex sloped surface 1316 may allow the bit to travel on a central portion of the sloped surface 1316 while lateral portions on either side of the central portion may be further from the bit 1326. The additional space along the lateral portions of the sloped surface 1316 may facilitate a greater removal rate of debris during drilling or milling.

As shown in FIG. 15, the movable member 1322 may be laterally constrained within the whipstock body 1318. For example, the movable member 1322 may move about parallel to the longitudinal axis 1320. In other embodiments, the movable member 1322 may move non-parallel to the longitudinal axis 1320. The movable member 1322 may move toward the connector 106 and/or may contact the bit 1326. In some embodiments, the movable member 1322 may apply a force to the bit 1326, the connection members 1310, the connector 1306, or any combination of the foregoing.

In some embodiments, the movable member 1322 may apply a force to the bit 1326 at a contact angle 1323 from the direction of motion of the movable member 1322. In some embodiments, the contact angle 1323 may be less than 30° from the direction of motion of the movable member 1322 (e.g., parallel to the longitudinal axis 120). In another embodiment, the contact angle 1323 may be greater than 60° from the direction of motion of the movable member 1322. In yet other embodiments, the contact angle 1323 may be between 30° and 60° from the direction of motion of the movable member 1322. In at least some embodiments, the contact angle 1323 may be between 15° and 175°. For instance, the contact angle 1323 may be within a range having lower and upper values that include any of 15°, 25°, 30°, 40°, 50°, 60°, 70°, 80°, 90°, 100°, 115°, 130°, 145°, 160°, 175°, or any value therebetween. For example, the contact angle 1323 may be between 75° and 105°, between 60° and 100°, or between 45° and 145°. In some embodiments, a lower contact angle may apply a greater force to the connector 1306 as the movable member 1322 moves, and therefore may aid in breaking the connector 1306.

The force applied by the movable member 1322 to the bit 1326 may at least partially facilitate severing of the connector 1306. For example, the force applied by the movable member 1322 may release the connection between the connection members 1310 and the bit 1326 or other delivery mechanism. In some embodiments, the force applied may alone be sufficient to break or otherwise release the connector 1306 (e.g., shear the shear pins 1308). In other embodiments, the force applied by the movable member 1322 may be one of a plurality of forces acting on the connector 1306. For example, the connector 1306 may, in addition to the force applied by the movable member 1322, experience a torque (e.g., the torque between a drill string and an anchor). In yet other embodiments, the connector 1306 may experience a longitudinal stress (e.g., an axial force applied between the drill string and the anchor as a result of the drill string pushing or pulling the bit 1326 longitudinally relative to the connection members 1310). In yet further embodiments, the connector 1306 may experience other or additional shear or release forces, or any combination of the aforementioned forces to break or otherwise release the connector 1306.

As described herein, in at least some embodiments, a connection between a delivery mechanism and a departure device according to the present disclosure may be capable of withstanding greater forces (torque and/or longitudinal force) as compared to a conventional connection. In at least one embodiment, the connector between a bit and departure device, as described herein, may disengage under an additional application of shear force beyond an amount of torque or longitudinal force the delivery mechanism may be able to produce, or is expected to produce. In at least one embodiment, and as depicted in FIG. 15, the force applied to the bit 1326 by the movable member 1322 may be sufficient to apply the additional force to sever or otherwise release the connector 1306. In another embodiment, the connector 1306 may be severable by the force applied between the delivery mechanism and the whipstock 1302. In some embodiments, the force applied by the movable member 1322 to the bit 1326 may not be used to assist in severing or releasing the connector 1306 and/or may be negligible.

A variety of actuation mechanisms may be used to move the movable member 1322. In the embodiment shown in FIG. 15, the departure device 1300 may include an actuation mechanism 1328 that applies a force to move the movable member 1322. In some embodiments, the actuation mechanism 1328 may be a hydraulic, pneumatic, electromagnetic, mechanical, or another type of mechanism, or combinations thereof. The actuator mechanism 1328 may include a piston and cylinder, a screw gear, a rack and pinion, a spring, a magnetic actuator, similar mechanisms, or combinations thereof.

In at least some embodiments, the actuation mechanism 1328 may be mounted in a cavity 1330 within the whipstock body 1318. The cavity 1330 may include a recess 1332 into which an actuation mechanism 1328, such as a spring, may nest. The recess 1332 may assist in directing a force from the actuation mechanism 1328 against the movable member 1322, and may be in-line with the path of movement of the movable member 1322 (e.g., parallel to the longitudinal axis 1320 of the departure device 1300). The recess 1332 and/or cavity 1330 may house the actuation mechanism 1328, which may limit or potentially prevent damage or other interference with the operation of the actuation mechanism 1328. In other embodiments, an actuation mechanism 1328 may be otherwise coupled to the whipstock body 1318 and/or movable member 1322. For instance, the actuation mechanism 1328 may be coupled to an exterior of the whipstock body 1318, enclosed within a sleeve on an exterior of the whipstock body 1318, or the like.

Figure 16:
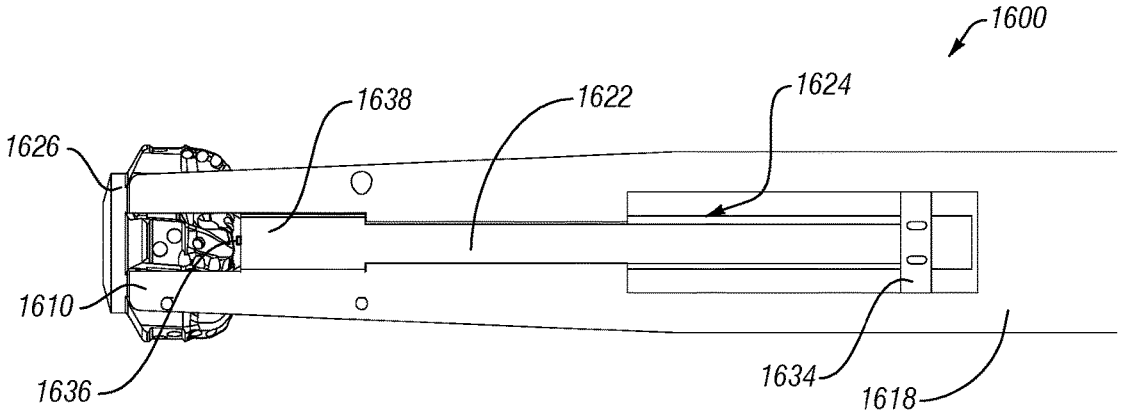
FIG. 16 is a bottom view of another embodiment of a bit and departure device, according to one or more embodiments of the present disclosure.

FIG. 16 illustrates another embodiment of a departure device 1600. The departure device 1600 may be similar to whipstocks or other departure devices described or depicted herein, and may include elements of the departure device 100. For example, the departure device 1600 may include a similar whipstock body 1618 and/or connection members 1610 extending therefrom. The connection members 1610 may couple to a bit 1626 to secure the departure device 1600 to a drill string and/or to transmit torque from the bit 1626 to the departure device 1600. The connection members 1610 may be coupled to the bit 1626 using any appropriate connector, such as, for example, those described in relation to FIG. 14.

The movable member 1622 may include a limiting member 1634. The limiting member 1634 may be fastened to the movable member 1622. The limiting member 1634 may limit movement of the movable member 1622 when the movable member 1622 moves from a retracted position toward an extended position. FIG. 16 illustrates the movable member 1622 in a retracted position. When moving to the extended position, the movable member 1622 may travel within a longitudinal channel 1624 in the whipstock body 1618. Optionally, the limiting member 1634 may abut or engage a portion of the whipstock body 1618 to limit further movement of the movable member 1622. For instance, a shoulder may be formed in the whipstock body 1618 and adjacent the longitudinal channel 1624 to limit axial movement in an uphole or downhole direction. The lateral side surfaces defining the longitudinal channel 1624 may be used to limit lateral movement of the movable member 1622. In some embodiments, the position of the limiting member 1634 may be adjustable relative to the movable member 1622. For example, the longitudinal/axial position of the limiting member 1634 may be adjustable relative to the movable member 1622. Adjusting the longitudinal position of the limiting member 1634 may affect the maximum translation of the movable member 1622 relative to the whipstock body 1618 in a proximal direction. In another example, the limiting member 1634 may abut or engage a portion of the whipstock body 1618 in the distal direction, thereby limiting distal longitudinal movement of the movable member 1622. In some embodiments, limiting distal longitudinal movement of the movable member 1622 may limit or even prevent damage to an actuator mechanism used to move the movable member 1622 (e.g., actuator mechanism 1328 of FIG. 15).

Also shown in FIG. 16 is an example tensile connector 1636 that may provide a connection between the bit 1626 and the movable member 1622. In some embodiments, the tensile connector 1636 may be a pull rod, an elastomer connection, a chain, a cable, a flexible connector, or combinations thereof. The tensile connector 1636 may provide a motivating/catalyst force to move the movable member 1622 from the retracted position toward the extended position. For example, as the bit 1626 moves longitudinally relative to the departure device 1600, the tensile connector 1636 may apply a tensile force to the movable member 1622 in a longitudinal direction. When the bit 1626 is disconnected from the departure device 1600, this tensile force may tend to move the movable member 1622 within a longitudinal channel 1624.

The tensile connector 1636 may be connected to a leading edge 1638 of the movable member 1622, as depicted in FIG. 16, or may be connected to another portion, such as another surface of the movable member 1622, or at one or more of a plurality of locations on the movable member 1622. In some embodiments, the tensile connector 1636 may operate in addition to, or instead of, an actuation mechanism that moves the tensile connector 1636 (e.g., actuation mechanism 1328 of FIG. 15). In some embodiments, the tensile connector 1636 may apply a force to pull the movable member 1622 through a full or partial range of the motion as the movable member 1622 moves between a retracted position and an extended position. The tensile connector 1636 may also apply a force to pull the movable member 1622 through a portion of the range of motion of the movable member 1622. In another embodiment, an actuation member (e.g., actuation mechanism 1328 of FIG. 15), may initially move the movable member 1622 through a portion of the longitudinal channel 1624 while the tensile connector 1636 may thereafter pull the movable member 1622 through another portion of the longitudinal channel 1624 to the extended position. In another embodiment, the tensile connector 1636 may pull the movable member 1622 through an initial portion of the longitudinal channel 1624, and the actuation mechanism may move the movable member 1622 through another portion of the longitudinal channel 1624 toward the extended position.

In some embodiments, the tensile connector 1636 may be connected to the bit 1626 and/or the movable member 1622 through a breakable connection. In yet another embodiment, the tensile connector 1636 may itself be breakable. In some embodiments, the tensile connector 1636 (or a connection between the tensile connector 1636 and the bit 1626 and/or the movable member 1622) may break upon receiving a force above a threshold value in a range of 2 to 10 kilopounds (8.9 to 44.5 kN). In other embodiments, the tensile connector 1636 may be configured to break when receiving a force in a range of 2 to 3 kilopounds (8.900 to 13.3 kN), or in a range of 3 to 4 kilopounds (13.3 to 17.8 kN). In further embodiments, the tensile connector 1636 may break when acted upon by a force within a range having lower and upper values that include any of 2.0, 2.25, 2.5, 2.75, 3.0, 3.25, 3.5, 3.75, 4.0, 5.0, 6.0, 7.0, 8.0, 9.0 or 10.0 kilopounds, (8.9, 10.0, 11.1; 12.2; 13.3; 14.4; 15.6; 16.7; 17.8, 22.2, 26.7, 31.1, 35.6, 40.0, or 44.5 kN), or any value therebetween. In other embodiments, the tensile connector 1636 may break or release when acted on by a force that is less than 2.0 kilopounds (8.9 kN) or more than 10.0 kilopounds (44.5 kN).

In some embodiments, the tensile connector 1636 may apply a force to and move the movable member 1622 until the limiting member 1634 strikes the whipstock body 1618. Tension on the tensile connector 1636 may increase to exceed the tensile strength of the tensile connector 1636 to break or otherwise release the tensile connector 1636 and leave the movable member 1622 in a fully or partially extended position.

Figure 17:
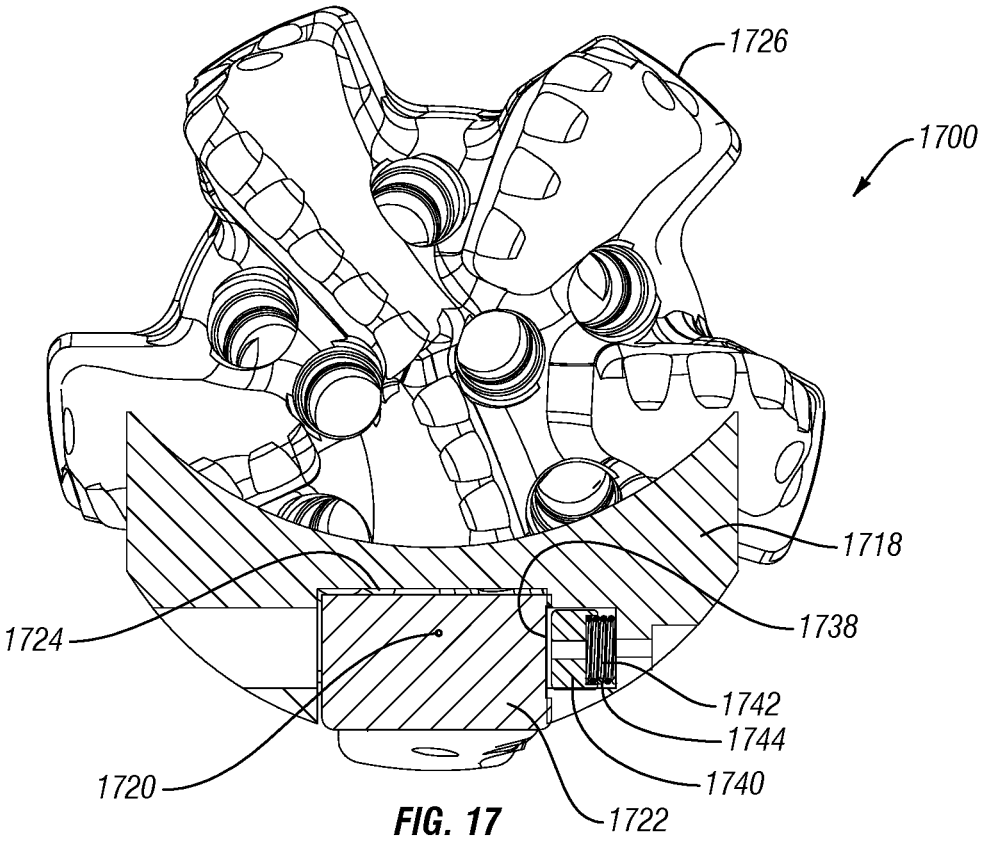
FIG. 17 is a transverse cross-sectional view of a departure device having a locking pin, according to one or more embodiments of the present disclosure.

In another embodiment shown in FIG. 17, a bit 1726 may be coupled to, or used with, a departure device 1700 including a movable member 1722 located at least partially within a longitudinal channel 1724 in a whipstock body 1718. The movable member 1722 may be similar to the movable members 1322, 1622 described in relation to FIGS. 13-16. In some embodiments, the movable member 1722 may have a longitudinal recess 1738 in a surface of the movable member 1722. For instance, the longitudinal recess 1738 may be in a lateral, exterior surface of the movable member 1722. In some embodiments, the longitudinal recess 1738 may extend an entire length of the movable member 1722. In other embodiments, the longitudinal recess 1738 may extend a portion of the length of the movable member 1722 that is less than the entire length. The departure device 1700 may include a locking mechanism such as locking pin 1740. In other embodiments, the departure device 1700 may have more than one locking mechanism. The locking pin 1740 may complimentarily align with the longitudinal recess 1738 in a transverse direction. For example, the locking pin 1740 may be cylindrical with a diameter that is about equal to or smaller than the width of the longitudinal recess 1738, such that the locking pin 1740 rests within the longitudinal recess 1738. The locking mechanism may restrict the movement of the movable member 1722 relative to the whipstock body 1718. For example, the locking mechanism may restrict the movement of the movable member 1722 when it is in a retracted position, an extended position, or at any position therebetween.

The locking pin 1740 may be pressed against the movable member 1722 by a locking pin actuator 1742. The locking pin actuator 1742 may be a spring, as shown in FIG. 17. In other embodiments, the locking pin actuator 1742 may be hydraulic, pneumatic, electronic, mechanical, or apply another type of force, or include any combination thereof. Additionally, the locking pin actuator 1742 may include a piston and cylinder, a screw gear, a rack and pinion, a magnetic actuator, other mechanisms, or combinations thereof. FIG. 17 also illustrates a locking pin recess 1744 in communication with a longitudinal channel 1724 into which a locking pin actuator 1742, such as a spring, may nest. The locking pin recess 1744 may assist in directing a force from the locking pin actuator 1742 against the movable member 1722 and in line with the path of movement of the movable member 1722, such as perpendicular to the longitudinal axis 1720 (depicted normal to FIG. 17) of the departure device 1700.

Figure 18:
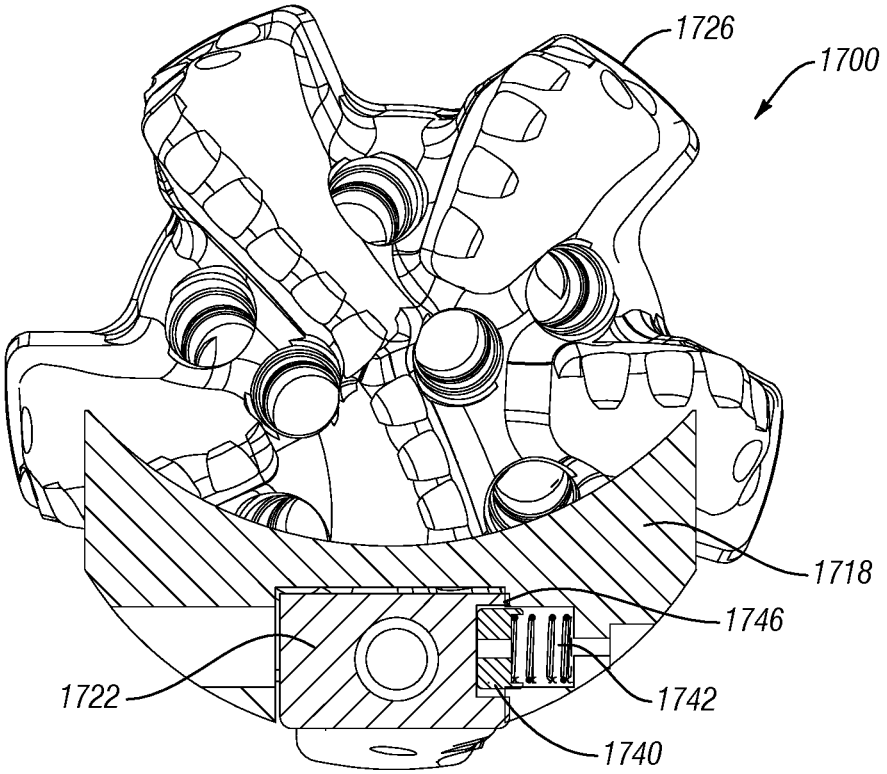
FIG. 18 is a transverse cross-sectional view of another embodiment of a departure device having an engaged locking pin, according to one or more embodiments of the present disclosure.

FIG. 18 shows the departure device 1700 with the movable member 1722 in an extended position. The movable member 1722 may include a locking recess 1746 in a surface in the movable member 1722. For instance, the locking recess 1746 may be nested within, or extend from, the longitudinal recess 1738. In some embodiments, the locking recess 1746 may align with the locking pin 1740. In other embodiments, the locking recess 1746 may align with the longitudinal recess 1738. In yet other embodiments, the locking recess 1746 may be part of the longitudinal recess 1738. In some embodiments, the locking pin 1740 may be a cylindrical pin with a circular cross-section. In other embodiments, the locking pin 1740 may have a non-circular cross-section, such as a square, rectangular, triangle, pentagon, hexagon, other regular polygons, irregular polygons, regular ellipsoid, other shapes, or combinations thereof. In some embodiments, the locking recess 1746 may be complimentarily shaped to receive the locking pin 1740 when the locking pin 1740 is aligned with the locking recess 1746 (e.g., when the movable member 1722 is in the extended position) and the locking pin actuator 1742 urges the locking pin 1740 into the locking recess 1746. In another embodiment, the locking recess 1746 may have some other shape, but be sized such that it may receive the non-complimentarily shaped locking pin 1740.

Figure 19:
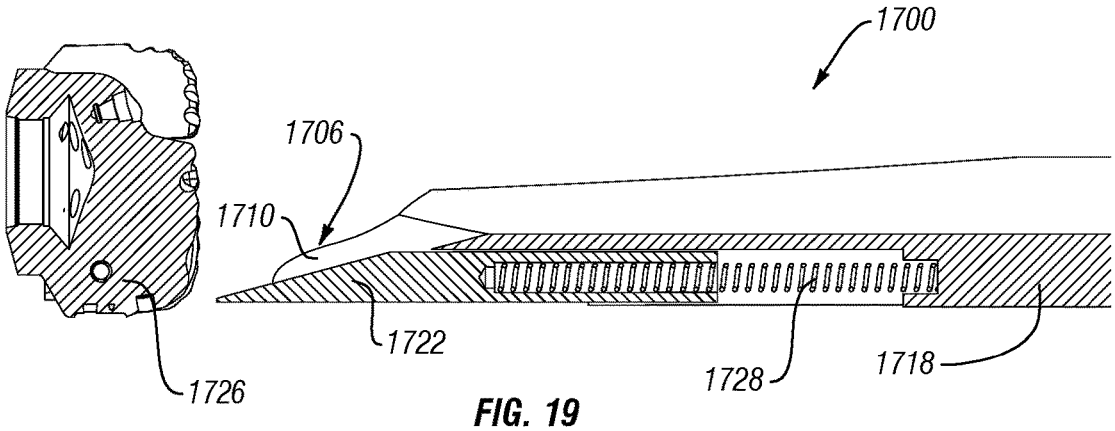
FIG. 19 is a cross-sectional side view of a further embodiment of bit and a corresponding a departure device having an extended movable member, according to one or more embodiments of the present disclosure.
Figure 20:
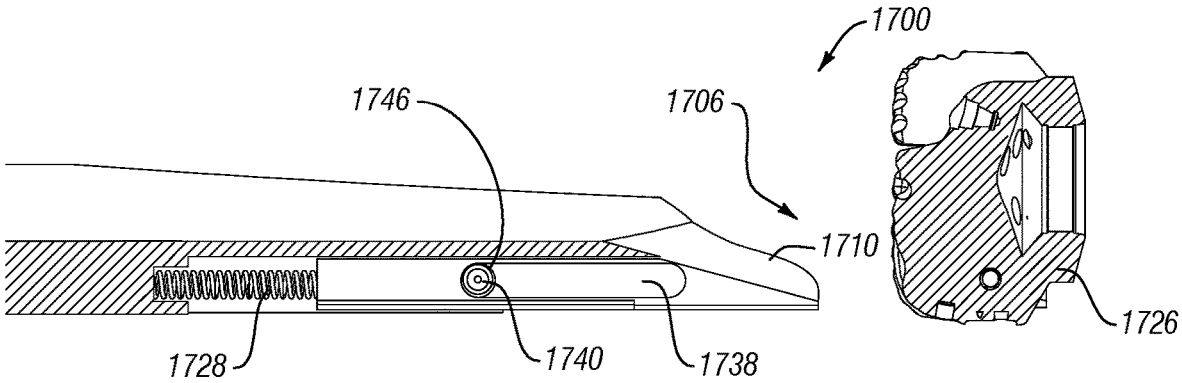
FIG. 20 is a cross-sectional side view of another embodiment of a bit and a corresponding departure device having an extended movable member with an engaged locking pin, according to one or more embodiments of the present disclosure.

FIGS. 19 and 20 depict the departure device 1700 with the movable member 1722 in an extended position. The connector 1706 (which may be similar to connector 106 in FIGS. 13-15) between the connection members 1710 and the bit 1726 is illustrated in a released or broken state, and the movable member 1722 may be locked in the extended position by the locking pin 1740. As shown in FIG. 20, the locking recess 1746 may limit the movement of the movable member 1722 toward the connector 1706 and bit 1726. The locking recess 1746 may receive the locking pin 1740, thereby limiting the longitudinal movement of the movable member 1722 in both the proximal and distal directions of the departure device 1700. In some embodiments, the locking pin 1740 and locking recess 1746 may be used with the limiting member 1634 shown in FIG. 16, with other similar locking mechanisms, or may be used alone. In other embodiments, the locking pin 1740 and locking recess 1746 may not be used and/or the limiting member 1634 (see FIG. 16) may not be used.

Figure 21:
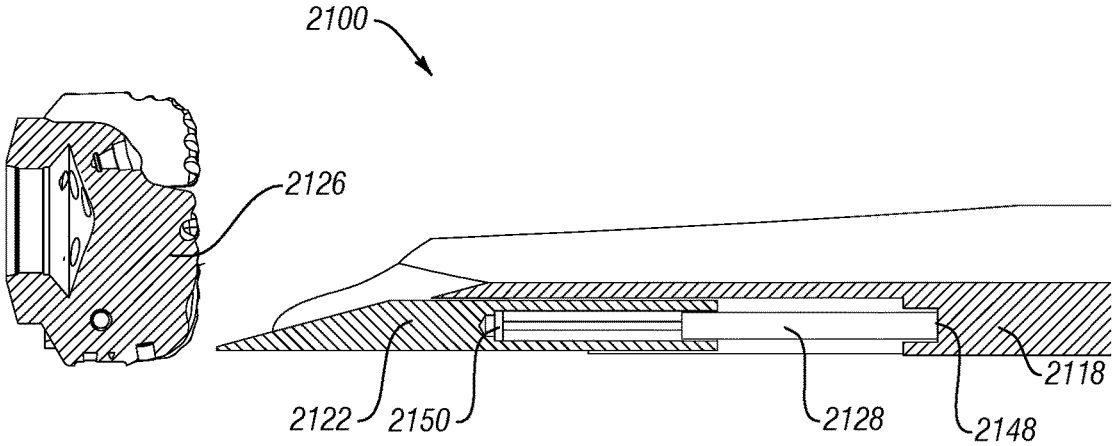
FIG. 21 is a cross-sectional side view of a bit and a corresponding departure device having a movable member actuated by a piston-and-cylinder, according to one or more embodiments of the present disclosure.

As depicted in FIG. 21, in some embodiments, a departure device 2100 may include an actuator mechanism 2128 that can apply forces in both a proximal longitudinal direction and a distal longitudinal direction. In the illustrated embodiment, a distal end 2148 of the actuator mechanism 2128 may be connected to a whipstock body 2118. A proximal end 2150 of the actuator mechanism 2128 may be connected to a movable member 2122. In the illustrated embodiment, the actuator mechanism 2128 may include a piston-and-cylinder, electromechanical, or gear-driven mechanism that is capable of moving the movable member 2122 to a longitudinal location relative to the whipstock body 2118. In the same or other embodiments, the actuator mechanism 2128 may be capable of holding the movable member 2122 at such a location. In such embodiments, the departure device 2100 optionally may not include a locking pin, limiting member, or similar retention member. The actuator mechanism 2128 may be used for selectively detaching the departure device 2100 from a bit 2126.

Figure 22:
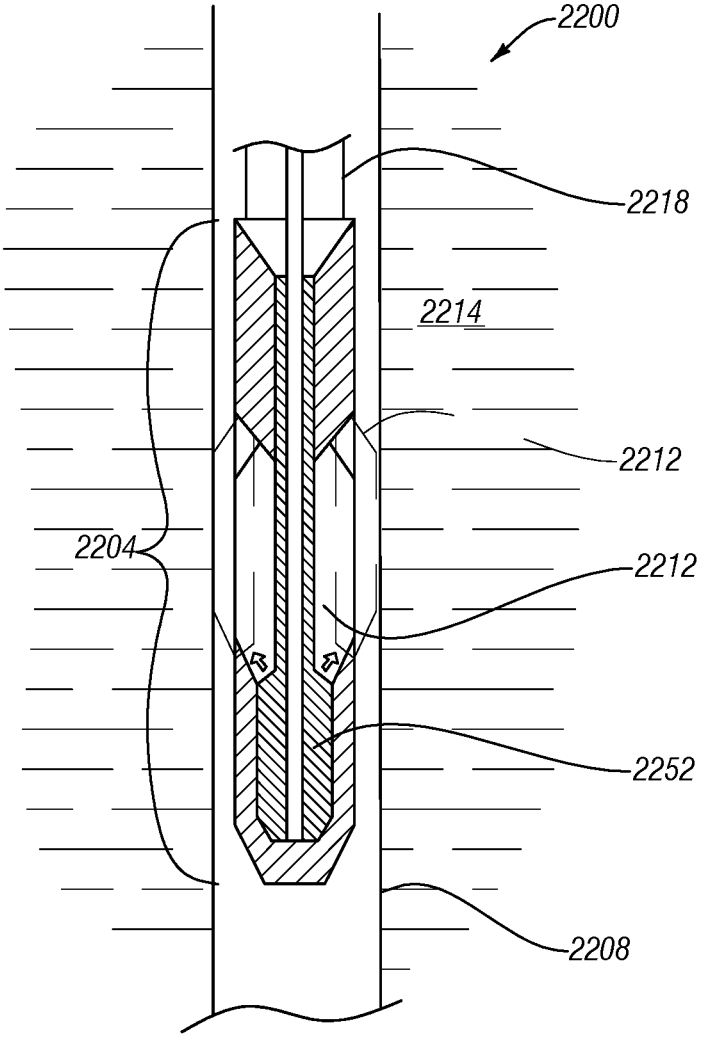
FIG. 22 is a cross-sectional, schematic view of a reinforced anchor, according to one or more embodiments of the present disclosure.

As discussed herein, some embodiments of the present disclosure may relate to departure devices that can be anchored or otherwise secured within a primary wellbore to facilitate formation of a lateral borehole. In embodiments in which an expandable anchor is used, the expandable anchor may be a reinforced anchor. A reinforced anchor may provide a stronger connection with the walls of an openhole primary wellbore. As shown in FIG. 22, a departure device 2200 may include a reinforced anchor 2204 coupled to a whipstock body 2218. The reinforced anchor 2204 may have a greater torque rating than traditional anchors. For example, the reinforced anchor 2204 may include a mandrel 2252 having an increased torque rating in a running mode to aid in navigation through an openhole environment. In other examples, the reinforced anchor 2204 may have a greater torque rating than traditional anchors due at least partially to having a larger diameter mandrel 2252, a longer or shorter length mandrel 2252, incorporating stronger materials in the mandrel 2252 and/or expandable members 2212, having a larger diameter connection between the reinforced anchor 2204 and the whipstock body 2218, or combinations thereof. The mandrel 2252 may move toward the expandable members 2212, which may include slips that anchor or grab into the formation 2214. Upon moving the mandrel 2252, the mandrel 2252 may impinge upon the expandable members 2212, and may thereby directly or indirectly apply an axial and/or outward force to move the expandable members 2212 from an undeployed position (solid lines) to a deployed position (dashed lines). The movement of the expandable members 2212 to a deployed position may apply a force to the primary wellbore 2208 sufficient to restrain movement of the departure device 2200 in the primary wellbore 2208. In the depicted embodiment, the expandable members 2212 may apply a compressive force directly to the surrounding formation 2214.

It should be understood that while elements are described herein in relation to depicted embodiments, each element may be combined with other elements of other embodiments. For example, the elements depicted in or described in relation to FIG. 22, may be combinable with any elements depicted in or described in relation to FIGS. 1-21. Similarly, the elements depicted in or described in relation to FIG. 21, may be combinable with any elements depicted in or described in relation to FIGS. 1-20 and so forth.

Figure 23:
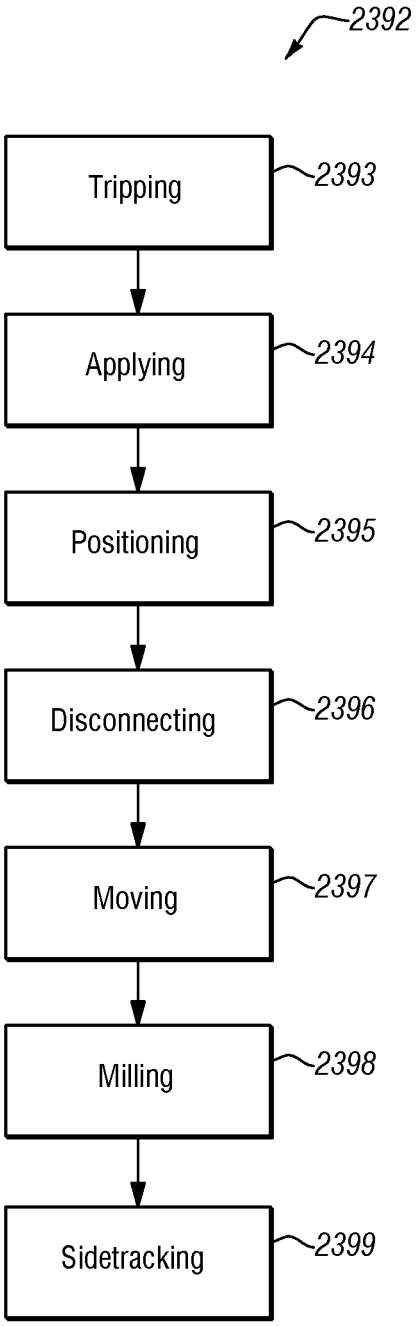
FIG. 23 is a flowchart depicting a method for milling, according to one or more embodiments of the present disclosure.

An example method 2392 of performing a sidetracking or wellbore departure procedure is shown in FIG. 23. The method 2392 may include tripping 2393 a downhole tool into a wellbore. The downhole tool may include a departure device, a bit, or other delivery mechanism, and a connector coupling the bit to the departure device. Upon tripping the downhole tool at 2393, a force may be applied to the downhole tool. Such forces may be applied from the surface (e.g., axial push or pull forces, torque, etc.), downhole (e.g., using a downhole motor), or by the formation/casing. In at least some embodiments, the connector of the downhole tool may be able to withstand the forces applied at 2394 without breaking or releasing.

When the downhole tool is in the wellbore, the departure device may be positioned at 2395. Positioning the departure device may include determining that the departure device is at a desired depth or axial position, at a desired rotational or azimuthal position, at a desired inclination, or at some other desired position. In at least some embodiments, positioning the departure device at 2395 may include securing the departure device within the wellbore. In an illustrative embodiment, the departure device may be secured in the wellbore using one or more expandable members of an anchor or packer to apply a compressive force to the lateral surface of adjacent casing or formation around the wellbore. In other embodiments, the departure device may be secured in the wellbore by extending one or more extendable members into a surrounding formation around the wellbore.

The method 2392 may also include disconnecting 2396 the delivery mechanism from the connector. Disconnecting at 2396 may include applying a force to the connector in an amount configured or otherwise designed to separate the connector from the delivery device or the departure device. For instance, an uphole-directed force may be applied to the delivery mechanism, which may in turn apply such force to the connector. The uphole-directed force may shear, break, or otherwise release a fastener of the connector, thereby separating the delivery mechanism from the departure device. In other embodiments, the force applied to perform the disconnecting at 2396 may be a downhole-directed force or a torque. In other embodiments, an actuation mechanism may cause a movable member to move to fully or partially provide a force to separate the delivery mechanism from the departure device. In still other embodiments, a data signal may be sent and received by the downhole tool, and in response a downhole controller may directly or indirectly release a fastener. In embodiments in which an axial force is used to disconnect the delivery mechanism from the departure device at 2356, the force may be may be greater than or equal to 50 kilopounds (222 kN) or 75 kilopounds (334 kN). In embodiments in which a torque is used to disconnect the delivery mechanism (e.g., after an anchor is set to restrict rotational and/or axial movement of the departure device), the torque may be greater than or equal to 5.0 kilofoot pounds (6.8 kN-m), 7.5 kilofoot-pounds (10.2 kN-m), or 15.0 kilofoot-pounds (20.3 kN-m).

Upon disconnection of the delivery mechanism from the departure device at 2396 (e.g., by releasing the connector), a bit or other portion of a delivery mechanism may be moved 2397 relative to the departure device. Moving the delivery mechanism at 2397 may include one or both of axially and rotationally moving the delivery mechanism. In at least some embodiments, the delivery mechanism 2397 may include a bit used in milling 2397 or otherwise degrading or removing the connector. After disconnecting at 2396, the connector may be located between the bit and the departure device, thereby obstructing a travel path for the bit along the departure device. Milling the connector at 2398 may therefore cut, break-up, or otherwise remove a full or partial portion of the connector to allow the bit to move toward the departure device (e.g., during moving of the delivery mechanism at 2397). Milling the connector at 2398 may allow the bit of the delivery mechanism to be moved to and reach the departure device, which can allow the departure device to deflect or otherwise cause the bit to initiate formation of a lateral borehole when sidetracking at 2399. As discussed herein, in some embodiments, the connector may include a greater volume of material than would be desired, and may not be structured to minimize the material to be milled at 2398. Rather, the connector may be designed to withstand greater forces in a downhole environment by adding additional material volume to be milled at 2398. In some embodiments, the material of the connector 2398 may be selected to be more millable than the material of the departure device. For instance, the hardness and/or yield strength of the materials of the connector 2398 may be a fraction of the hardness or yield strength of the materials of the departure device. For instance, a ratio of the hardness or yield strength of the connector relative to the hardness or yield strength of the departure device may be within a range having lower or upper limits including any of 0.25, 0.3, 0.4, 0.5, 0.6, 0.7, 0.75, 0.8, 0.9, or values therebetween. In other embodiments, a ratio of the hardness or yield strength of the connector relative to the hardness or yield strength of the departure device may be less than 0.25 or greater than 0.9.

Figure 24:
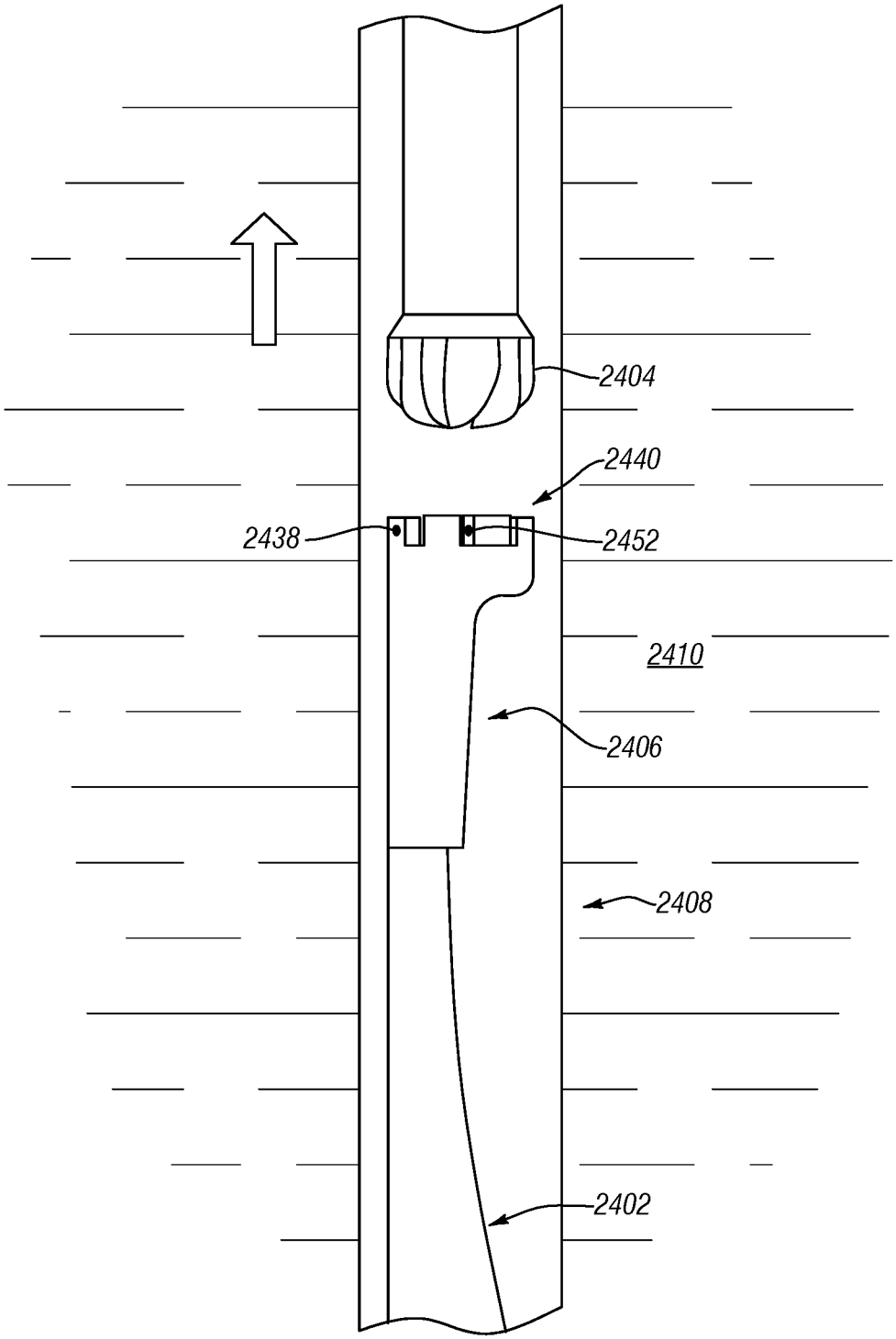
FIG. 24 is a schematic representation of a downhole system while releasing a connection between a connector and a bit within a wellbore, according to one or more embodiments of the present disclosure.

FIG. 24 depicts a bit 2404 being disconnected from a connector 2406 and a departure device 2402 by applying an uphole-directed pull force on the bit 2404, according to some embodiments of the present disclosure. The departure device 2402 may be secured relative to the wellbore 2408 and the surrounding formation 2410. For example, the departure device 2402 may include an expandable anchor (not shown) that may have one or more expandable members, such as slips or packer elements, which may be expanded against the wellbore 2416 or the surrounding formation 2410 to limit axial, rotational, or other movement of the departure device 2402 within the wellbore 2408 and formation 2410. The bit 2404 may be pulled upwardly, which may apply an uphole-directed force on one or more pull loading areas 2452. Due at least in part to the departure device 2402 being secured relative to the wellbore 2408 or the surrounding formation 2410, the downhole tool may resist such a pull force. The delivered force may exceed a shear threshold of one or more shear elements, such as shear pins 2438, coupling the bit 2404 to a proximal end portion 2440 of the connector 2406. In at least some embodiments, the shear threshold of the connector 2406 may be equal to or less than 50 kilopounds (222 kN) or 75 kilopounds (334 kN).

Figure 25:
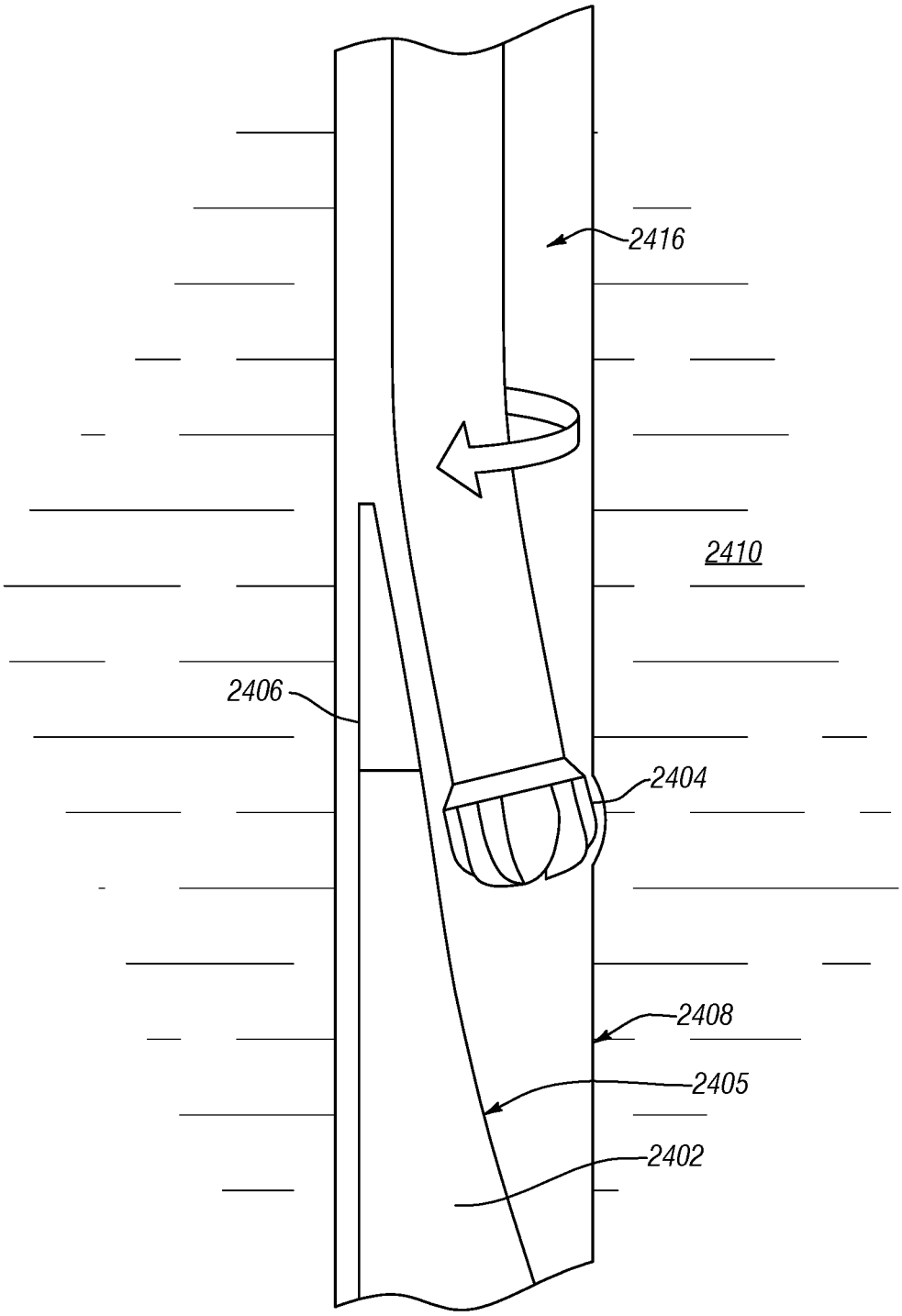
FIG. 25 is a schematic representation of the downhole system of FIG. 14 while milling the connector, according to one or more embodiments of the present disclosure.

FIG. 25 depicts milling of a connector 2406 to remove at least a portion of the connector 2406 according to some embodiments. After disconnecting the bit from the connector as described in relation to FIG. 24, the bit 2404 and drill string 2416 may be moved relative to the wellbore 2408, the surrounding formation 2410, and the departure device 2402. For instance, the drill string 2416 may be advanced downhole toward the departure device 2402 and the connector 2406. The bit 2404 may rotate and move downhole to remove at least a portion of the connector 2406. The bit 2404 may mill through at least a portion of the connector 2406 until the bit 2404 reaches the departure device 2402. In some embodiments, the connector 2406 may be made of a first material and the departure device 2402 may be made of or include a second material having a higher yield strength, hardness, or both yield strength and hardness as compared to the first material. In some embodiments, a yield strength or hardness ratio of the first material to the second material may be equal to or less than 1.0. In other embodiments, a yield strength or hardness ratio of the first material to the second material may be equal to or less than 0.5. In further embodiments, a yield strength or hardness ratio of the first material to the second material may be equal to or less than 0.45. The higher yield strength and/or hardness of the second material may allow the departure device 2402 to deflect the bit 2404 or otherwise change the direction of the bit 2404.

The departure device 2402 may include a ramp 2405 or other inclined surface used to deflect the bit 2404 laterally to initiate formation of a lateral borehole. Optionally, removal of the connector 2406 may allow at least a portion of the connector 2406 to remain coupled to the departure device 2402. In some embodiments, lateral movement of the bit 2404 may result in forming an inclined surface of the connector 2406 which substantially continuous with the ramp 2405 of the departure device 2402. The bit 2404 may move laterally relative to the wellbore 2408 and may enter the surrounding formation 2410, thereby initiating and forming a lateral borehole.

In at least some embodiments, a connector between a bit and a departure device in accordance with the present disclosure may allow a departure device to be positioned in a wellbore whereas conventional in a wellbore conventional bit to whipstock connectors are unable to withstand downhole forces to reliably position a whipstock. At least part of the connector may be removable by the bit and used to deliver and position the departure device within the wellbore. Where the connector is configured or otherwise designed to be milled more easily than the departure device for reasons other than the geometry of the departure device (e.g., due to material properties that allow material(s) of the connector to be milled quickly, with less forces, with reduced wear to cutting elements, or the like when compared to material(s) of the departure device), the connector may be considered a millable connector. A millable connector may facilitate the delivery of a departure device and forming of a lateral borehole in a single trip.

While embodiments of the present disclosure have been primarily described with reference to wellbore drilling operations, departure devices, connectors, delivery devices, and other components described herein may be used in applications other than the drilling of a wellbore or borehole. In other embodiments, departure devices, connectors, delivery devices, and the like may be used outside a wellbore or other downhole environment used for the exploration or production of natural resources. For instance, departure devices connectors, delivery devices, and the like of the present disclosure may be used in a wellbore used for placement of utility lines. Accordingly, the terms "wellbore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. The terms "comprising," "including," and "having" are intended to be inclusive and mean that there may be additional elements other than the listed elements. Any element described in relation to an embodiment herein may be combinable with any element of any other embodiment described herein. Numbers, percentages, ratios, or other values stated herein may be provided as a list of potential lower or upper limits within a range. It is contemplated that any such value may be a lower limit or an upper limit of a closed-ended range (e.g., between 50% and 75%), or an open-ended range (e.g. at least 50%, up to 50%). Listed values are further intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. It should be understood that "proximal," "distal," "uphole," and "downhole" are relative directions. As used herein, "proximal" and "uphole" should be understood to refer to a direction toward the surface, rig, operator, or the like. "Distal" or "downhole" should be understood to refer to a direction away from the surface, rig, operator, or the like. The terms "couple," "coupling," "connect," "connecting," "attach," "attaching," and the like should be interpreted to include direct connections, indirect connections (e.g., through one or more intermediate components), and integral connections (e.g., formed of the same material and/or during a same formation process).

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A connector for coupling a bit to a departure device, comprising:

a body having a proximal end and a distal end and a yield strength between 205 MPa and 485 MPa;

a push loading area at the proximal end of the body, the push loading area configured to receive an axial force;

a torque loading area at the proximal end of the body, the torque loading area configured to receive a torque;

a push transmission area at the distal end of the body, the push transmission area configured to transmit the axial force; and a torque transmission area at the distal end of the body, the torque transmission area configured to transmit the torque;

wherein the proximal end of the body is configured to be connected to the bit and the distal end of the body is configured to be connected to the departure device.

2. The connector of claim 1, the body having a yield strength between 380 MPa and 450 MPa.

3. The connector of claim 1, the body being made of aluminum bronze.

4. The connector of claim 1, the body defining one or more recesses extending from the proximal end portion toward the distal end portion of the body.

5. The connector of claim 4, at least a portion of the torque loading area being located on a laterally-facing surface adjacent at least one of the one or more recesses, or at least a portion of the push loading area being located on an axially-facing surface adjacent at least one of the one or more recesses.

6. A downhole tool, comprising:

a bit;

a departure device formed of a first material; and a connector coupling the bit to the departure device, wherein, the connector comprises a body and is coupled to the bit nearer to a proximate end of the connector than to a distal end of the connector and to the departure device nearer to the distal end of the connector than the proximal end of the connector;

the distal end of the connector comprises a push transmission area for transmission of axial force in a downhole direction from the connector to the departure device and a torque transmission area for transmission of torque from the connector to the deviation device, at least a portion of the torque transmission area being located on a lateral or circumferentially facing surface of the body; and the connector being formed of a second material that is more millable than the first material.

7. The tool of claim 6, a yield strength of the second material being between 345 MPa and 485 MPa, and a ratio of a yield strength of the second material to a yield strength of the first material being less than 0.6.

8. The tool of claim 6, a yield strength of the first material being at least 970 MPa, and a ratio of a yield strength of the second material to a yield strength of the first material being less than 0.45.

9. The tool of claim 6, the connector being coupled to the bit by one or more shear elements having a threshold rating between 178 kN and 270 kN, the one or more shear elements being located adjacent a pull loading area configured to withstand forces up to the threshold rating of the one or more shear elements.

10. The tool of claim 6, the proximal end of the connector having a transverse cross-sectional area that is between 50% and 80% of a transverse cross-sectional area of the bit.

11. The tool of claim 6, the proximal end of the connector defining a plurality of recesses extending from the proximal end of the connector toward the distal end end of the connector, the recesses complimentarily mating with one or more bit blades of the bit.

12. The tool of claim 11, the one or more recesses being adjacent to one or more push loading areas and one or more torque loading areas.

13. The downhole tool of claim 6, further comprising a movable member configured to move at least partially within the departure device, the movable member including a surface configured to align coherently with a sloped surface of the departure device.

14. The downhole tool of claim 13, further comprising: an actuation mechanism configured to move the movable member, the actuation mechanism including at least one of a piston-and-cylinder, a screw gear, an electromechanical actuator, or a spring.

15. The downhole tool of claim 13, further comprising: a tensile connector coupled to the movable member and the bit and configured to apply a tension force to the movable member or a locking mechanism configured to selectively fix a position of the movable member relative to an elongate body of the departure device.

16. The downhole tool of claim 6, the connector including a plurality of connection points for selectively coupling to the bit, each of the plurality of connection points including a shear element.

17. The downhole tool of claim 6, wherein at least part of the torque transmission area is at least a portion of a surface that forms a recess configured to receive a portion of the departure device.

18. The downhole tool of claim 6, wherein at least part of the torque transmission area is at least a portion of a surface that forms an opening configured to receive a portion of the departure device.

19. The downhole tool of claim 6, wherein the torque transmission area comprises one or more splines configured to complimentary mate with one or more recesses on the departure device.

20. A wellbore departure method, comprising:

tripping a downhole tool into a wellbore, the downhole tool including a departure device, a bit, and a connector coupling the bit to the departure device, the connector being configured to be more millable than the departure device;

positioning the departure device in the wellbore;

disconnecting the bit from the departure device;

moving the bit relative to the departure device; and milling the connector using the bit;

wherein the connector comprises a body and is coupled to the bit nearer to a proximate end of the connector than to a distal end of the connector and the connector is coupled to the to the departure device nearer to the distal end of the connector than the proximal end of the connector;

wherein the distal end of the connector comprises a push transmission area for transmission of axial force in a downhole direction from the connector to the departure device and a torque transmission area for transmission of torque from the connector to the deviation device; and wherein the torque transmission area is located on a lateral or circumferentially facing surface of the body.

21. The method of claim 20, wherein positioning the departure device includes anchoring the departure device in the wellbore, and wherein disconnecting the bit from the departure device includes applying an uphole-directed force on the bit to disconnect the bit from the connector.

22. The method of claim 21, the uphole-directed force being greater than or equal to 222 kN.

23. The method of claim 20, wherein milling the connector using the bit includes at least one of milling a proximal end portion of the connector or deflecting the bit upon contact with the departure device such that at least a portion of the connector forms a ramp.

* * * * *